US007452172B2

(12) United States Patent
Parker et al.

(10) Patent No.: US 7,452,172 B2
(45) Date of Patent: Nov. 18, 2008

(54) METHOD OF MAKING AND APPLYING A HARDCOVER OVER-WRAP AND GUIDE APPARATUS

(75) Inventors: Kevin P. Parker, Berkeley, CA (US); Wayne Kasom, Oakland, CA (US); Brandon A. Lee, Daly City, CA (US)

(73) Assignee: Powis Parker Inc., Berkeley, CA (US)

( * ) Notice: Subject to any disclaimer, the term of this patent is extended or adjusted under 35 U.S.C. 154(b) by 642 days.

(21) Appl. No.: 10/999,801

(22) Filed: Nov. 30, 2004

(65) Prior Publication Data

US 2006/0115347 A1 Jun. 1, 2006

(51) Int. Cl.
*B42C 11/00* (2006.01)

(52) U.S. Cl. ..... 412/4; 412/19; 412/33; 412/8

(58) Field of Classification Search ..... 412/3, 412/4, 8, 17, 19, 33, 36, 37; 281/21.1, 29; 33/562, 566, 623
See application file for complete search history.

(56) References Cited

U.S. PATENT DOCUMENTS

| | | | | |
|---|---|---|---|---|
| 2,150,104 A | * | 3/1939 | Winfred | 412/14 |
| 2,294,347 A | | 8/1942 | Bauer | 154/46 |
| 3,715,260 A | | 2/1973 | Dornemann et al. | 156/477 B |

(Continued)

FOREIGN PATENT DOCUMENTS

| | | | |
|---|---|---|---|
| CN | 991219 | 6/1976 | 281/6 |

(Continued)

OTHER PUBLICATIONS

PCT Publication No. WO 99/39917, Publication Date Aug. 12, 1999.

(Continued)

*Primary Examiner*—Derris H. Banks
*Assistant Examiner*—Jamila Williams
(74) *Attorney, Agent, or Firm*—Girard & Equitz LLP

(57) ABSTRACT

Guide apparatus for forming and applying an over-wrap sheet to a book hardcover including a base unit having a width greater than the width of the hardcover and a length greater than the length of the hardcover, with the base unit including a hardcover receiving area and first and second orthogonal stops supported on the base unit for engaging first and second respective orthogonal edges of a cut over-wrap sheet. Third and fourth orthogonal stops are provided which are supported on the base unit for engaging first and second orthogonal edges of a hardcover placed on the hardcover receiving area. The third stop is substantially parallel to the first stop and disposed intermediate a center of the hardcover receiving area and the first stop and the fourth stop is substantially parallel to the second stop and disposed intermediate the center of the hardcover receiving area and the second stop, with the third and forth stops extending a distance away from the base unit less than a distance that the first and second stops extend away from the base unit so that the first and second stops do not interfere with placement of the over-wrap sheet over the hardcover and abutting the first and second stops. A reticule is included which is disposed on the base unit for aligning the base unit over an over-wrap sheet.

(Continued)

8 Claims, 32 Drawing Sheets

U.S. PATENT DOCUMENTS 3,749,422 A 7/1973 Abildgaard et al. ..... 281/21
3,816,866 A 6/1974 Miaskoff et al. ..... 11/3
3,847,718 A 11/1974 Watson ..... 161/39
3,912,304 A 10/1975 Abildgaard et al.
3,964,770 A 6/1976 Abildgaard et al. ..... 281/29
RE29,105 E 1/1977 Miaskoff et al. ..... 11/3
4,126,982 A 11/1978 Ito et al. ..... 53/593
4,129,914 A 12/1978 Jahn ..... 11/2
4,184,218 A 1/1980 Hawkes ..... 11/1 AD
4,299,410 A 11/1981 Jukola ..... 281/21 R
4,314,716 A 2/1982 Errichiello ..... 281/29
4,377,430 A 3/1983 Bexley et al. ..... 156/184
4,420,282 A 12/1983 Axelrod ..... 412/4
4,496,617 A 1/1985 Parker ..... 428/55
4,537,544 A 8/1985 Joost ..... 412/5
4,615,541 A 10/1986 Kwauka ..... 281/29
4,650,216 A 3/1987 Carlson ..... 281/34
D293,301 S * 12/1987 Deering ..... D10/62
4,762,341 A 8/1988 Rabuse
4,800,110 A 1/1989 DuCorday ..... 428/43
4,898,506 A 2/1990 Lazar ..... 412/8
4,906,156 A 3/1990 Axelrod
5,044,857 A * 9/1991 Crudo ..... 412/19
5,052,872 A * 10/1991 Hunder et al. ..... 412/6
5,052,873 A 10/1991 Parker et al. ..... 412/13
5,066,183 A 11/1991 Tholerus ..... 412/4
5,078,563 A 1/1992 Lolli ..... 412/8
5,154,447 A 10/1992 Tooker ..... 281/21.1
5,174,556 A 12/1992 Taylor et al. ..... 270/1.1
5,193,962 A 3/1993 Parker et al. ..... 412/8
5,340,155 A 8/1994 Podosek ..... 281/29
5,346,350 A 9/1994 Luhman et al. ..... 412/37
5,364,215 A 11/1994 Snellman et al. ..... 412/3
5,452,920 A 9/1995 Parker ..... 281/21.1
5,569,011 A 10/1996 Yamaguchi et al. ..... 412/9
5,601,312 A 2/1997 Funkhouser ..... 281/21.1
5,601,915 A 2/1997 Ochi et al. ..... 428/323
5,605,425 A 2/1997 Schaefer ..... 412/4
5,613,711 A 3/1997 Parker ..... 281/21.1
5,727,816 A 3/1998 Ong
5,779,423 A 7/1998 Bermingham ..... 412/4
5,829,150 A * 11/1998 McEligot ..... 33/562
5,829,938 A 11/1998 Hartwig et al. ..... 412/8
5,833,423 A 11/1998 Yamaguchi et al. ..... 412/8
5,997,964 A 12/1999 Klima, Jr. ..... 428/1
6,010,157 A 1/2000 Pierson et al.
6,024,525 A 2/2000 Yamanaka ..... 412/36
6,056,493 A 5/2000 Hartwig et al. ..... 412/8
6,065,884 A 5/2000 Parker et al. ..... 400/611
6,155,763 A 12/2000 Parker et al. ..... 412/6
6,158,776 A 12/2000 Purcocks
6,174,120 B1 1/2001 Kalisher ..... 412/1
6,322,867 B1 11/2001 Rush et al. ..... 428/40.1
6,332,630 B1 12/2001 Wolff et al.
6,599,074 B2 7/2003 Parker ..... 412/33
6,619,900 B2 9/2003 Cobene, II et al. ..... 412/1
6,641,345 B2 11/2003 Cobene, II et al. ..... 412/1
6,685,415 B2 2/2004 Rush et al. ..... 412/37
6,709,727 B1 3/2004 Parker ..... 428/40.1
7,134,822 B2 * 11/2006 Parker et al. ..... 412/19
7,153,076 B2 * 12/2006 Parker et al. ..... 412/4
7,246,981 B2 * 7/2007 Parker ..... 412/8
2004/0120793 A1 * 6/2004 Parker ..... 412/8
2006/0198719 A1 * 9/2006 Parker et al. ..... 412/4

FOREIGN PATENT DOCUMENTS

JP 403227698 A 10/1991 ..... 312/184

OTHER PUBLICATIONS

U.S. Appl. No. 2004/0066030 A1, filed Apr. 8, 2004, Kevin P. Parker.
U.S. Appl. No. 2004/0120793 A1, filed Jun. 24, 2004, Kevin P. Parker.
U.S. Appl. No. 2004/0067123 A1, filed Apr. 8, 2004, Parker et al.
U.S. Appl. No. 2004/0120794 A1, filed Jun. 24, 2004, Kevin P. Parker.
U.S. Appl. No. 10/968,357, filed Oct. 19, 2004 and entitled "Method of Applying a Wrap Sheet to a Book Hardcover and Related Guide Apparatus".
Seal and View® "Clear Label Protectors" Self Adhesive Stock No. CLL manufactured by Smead, Hastings Minnesota.
U.S. Appl. No. 2002/0064437 A1, filed May 30, 2002, Kuramoto et al.

* cited by examiner

METHOD OF MAKING AND APPLYING A HARDCOVER OVER-WRAP AND GUIDE APPARATUS

BACKGROUND OF THE INVENTION

1. Field of the Invention

The present invention relates generally to the field of bookbinding and, in particular, to a method of fabricating and applying an over-wrap for a hardcover book and related guide apparatus.

2. Description of Related Art

Binding systems for binding stacks of sheets into a book using desktop equipment have increased in popularity. One popular system uses a binder strip having and adhesive surface, such as disclosed in U.S. Pat. No. 4,496,617. The binder strip is typically applied to a stack of sheets to be bound using a desktop binding machine such as disclosed in U.S. Pat. No. 5,052,873. The binding machine carries out the binding operation by suitably positioning the binder strip relative to the stack to be bound and applying heat and pressure so that the edges of the stack are bound. The bound stack does not, however, have the same general appearance as books using commercial binding processes, particularly that of hardcover books.

Various approaches have been used to produce hardcover books using desktop equipment that closely resembles mass produced hardcover books. One successful prior art approach will now be described. Referring to the drawings, FIG. 1 shows a stack of sheets 15 to be bound into a hardcover book. A first folded liner sheet 12, forming sheets 12A and 12B the same size as the sheets to be bound, is positioned on the top of the stack 15 and a second folded liner sheet 14, forming sheets 14A and 14B, is positioned on the bottom of the stack. The liner sheets 12 and 14 are preferably of a relatively heavy stock as compared to the sheets 15 to be bound. Once the liner sheets 12, 14 and stack of sheets 15 have been assembled, the combined stack 10 is bound together using a conventional binder strip 16 as described in U.S. Pat. No. 4,496,617, the contents of which are hereby fully incorporated by reference into the present application. The actual binding is preferably is carried out using a desktop binding machine as described in U.S. Pat. No. 5,052,873, the contents of which are hereby fully incorporated by reference into the present application. The bound stack 10 is shown in FIG. 2, with the adhesive present in the binder strip 16 operating to bind the individual sheets together and to the paper substrate of the binder strip 16.

FIG. 3 shows details of a prior art hardcover assembly 18 that is applied to the bound stack 10 of FIG. 2. Typically, the cover assembly 18 is completely assembled and sold separately to the user. As will be described, the cover assembly 18 can be manufactured in various sizes to accommodate differing size stacks 10 in terms of stack thickness. It is further anticipated that a user can request that certain information be preprinted on the assembly 18, including title information and any other graphics. As will be described, hardcover assembly 18 includes the front and back cover sections halves 18A and 18B, respectively, separated by a spine section 18C.

The cover assembly 18 includes a pair of relatively stiff cover boards 24A and 24B made of cardboard or the like. The cover boards 24A and 24B are typically 8⅜ inches by 11 5/16 inches for binding 8½ by 11 inch stack 10. The cover boards are covered with a flexible cover membrane 22, typically fabric, which is folded around the edges of the cover boards, as depicted in FIG. 3. That part of the cover membrane 22 disposed intermediate the opposite edges 25A and 25B of the cover boards is unsupported and is thus relatively flexible. A length of fabric or stiff paper, typically 0.010 inches thick, is preferably disposed in the spine section 18C of the hardcover assembly 18 so as to slightly stiffen the membrane 22 in that location so that a desired shape is achieved when the bound book is opened and closed. The membrane regions 28A and 28B disposed between the respective edges of the spine section 26 and the respective edges 25A and 25B of the cover boards 24A and 24B are referred to as gutter regions. The gutter regions 28A and 28B are each fixed in width at ⅜ of an inch. The gutter regions define the flexible portion of the cover membrane. Alternatively, a spine board (not depicted), made of the same material as the cover boards 24A and 24B and having a shape that generally corresponds to the spine region 26, can be used. The spine board, which is typically 0.088 inches thick, functions to stiffen the spine 26, with spine flexibility being provided by the flexible gutter regions 28A and 28B disposed between the respective edges of the cover boards 24A and 24B and the respective edges of the spine board. When the spine board is used, the gutter region 28A and 28B widths are preferably increased slightly to 7/16 of an inch.

The spine region 26 width varies, along with the width of the spine board if one is used, depending upon the width of the stack 10 to be bound. The cover assemblies are preferably prefabricated in various widths to accommodate stacks 10 of various widths as set forth below in Table 1.

TABLE 1

| Model | Spine 26 Width (inches) | Stack Thickness (inches) |
|---|---|---|
| A | ⅜ | To ¼ |
| B | ½ | ¼ to ½ |
| C | ¾ | ½ to ¾ |
| D | 1 | ¾ to 1 |
| E | 1¼ | 1 to 1¼ |
| F | 1½ | 1¼ to 1½ |

The number of available spine widths can be increased or decreased from the values set forth above in Table 1, with a larger number increasing the difficulty of maintaining an adequate inventory and a smaller number detracting somewhat from the appearance of the final product in the spine region.

Referring back to FIG. 3, the cover assembly 18 is prefabricated using a pair of pressure sensitive adhesive sheets structure 30A and 30B. Further details of the adhesive sheets are also shown in FIGS. 4 and 5. Adhesive sheet structures 30A and 30B are dimensioned 8¼ by 10¾ inches when the stack 10 size is 8½ by 11 inches, to cover the interior periphery of the folded portions of the cover membrane 22A and 22B and to further secure the periphery of the membrane to the respective cover boards 24A and 24B. The smaller size of the underlying sheets 32A and 32B of the sheet structure ensures that the folded liner sheets 12A and 14A completely cover sheets 32A and 32B despite any small misalignment. Each sheet structure includes a respective bottom sheets 32A and 32B and an upper major release liner 36A and 36B. A layer of pressure sensitive adhesive 34A and 34B is disposed intermediate that upper liner and bottom sheet. A pressure sensitive adhesive manufactured by National Starch and Chemical Company and marketed under the designation Instant-Lok, type HL PSA 20-81, has been found suitable for this application. The adhesive layers 34A and 34B are preferably 0.003 to 0.004 inches in thickness.

The upper major release liners 36A and 36B are disposed over a majority of the underlying pressure sensitive adhesive layers. Generally, at least 75% of the adhesive layers are covered by the respective upper major release liners 36A and 36B, with a remaining strip of the adhesive along the inner edge of the sheet structures not being covered by the major release liners 36A and 36B. Instead, upper minor release liners 38A and 38B are disposed over the exposed adhesive strips. This relationship is shown schematically in FIG. 5 (not to scale) where a portion of the sheet structure 30B is depicted. As can be seen, the pressure sensitive adhesive layer 34B is disposed between the bottom sheet 32B and upper major and minor release liners 36B and 38B. That portion of the adhesive layer 34B not covered by the upper major release liner 36 is covered by a separate upper minor release liner 38B. The minor release liner 38B is actually positioned contacting the adhesive layer 34B and is secured in place by the adhesive layer. As is well known, all of the release liners 36A, 38A, 36B and 38B are fabricated from a material that only slightly adheres to the pressure sensitive adhesive so that the release liners can be manually separated from the adhesive without damage to the adhesive or the release liners. As part of the prefabrication of the hardcover assembly, conventional case glue 56 (not depicted in FIGS. 4 and 5) is applied to the top of the cover sections 18A and 18B and to the bottom sheets 32A and 32B. The sheet structures are then positioned over the respective cover sections 18A and 18B as shown in FIG. 3 so that the sheet structures will be secured to the cover sections by the case glue. Thus, the sheet structures 30A and 30B are secured to the cover boards 24A and 24B and to the peripheral portions of the cover membrane 22 by way of the case glue. This completes the prefabrication of the hardcover assembly 18.

Referring now to FIGS. 6 and 7, a prior art guide apparatus 40 is disclosed for use in carrying out the binding process. The guide apparatus includes a flat base member having a receiving surface 42 that is somewhat larger that the largest book to be bound when the book is in the open position. A stop member 44 having two orthogonal segments is supported on the upper surface 42 of the base member and extends around two adjacent sides of the base member. A ledge member 46, also having two orthogonal segments, is supported above the stop member 44 and, as can be in FIG. 7, have outer edges 46A which extend past the edge 44A of the stop member a small distance X, with the overhang being typically 0.14 inches. The height of the ledge member above the support surface is great enough to accommodate the thickness of the cover sections 18A and 18B of the cover assembly 18. The ledge member 46 extends along stop member 44 in one direction a distance Y (FIG. 6) which is somewhat smaller than the closed width of the smallest book to be bound. The distance Z, the distance that the ledge member 46 extends along stop member 44 in the other direction, is typically about twice dimension Y.

The guide apparatus 40 also preferably includes two or more vertical stop members, such as 48A, 48B and 48C, with vertical stop member 48A being supported on ledge member 46 about one third of the distance Y of the ledge member from the corner formed by the intersection of the two ledge member 46 segments. Vertical stop member 48B and 48C are at approximate equal distances along the other ledge member 46 segment. As can best be seen in FIG. 7, the vertical stop members each have a planar surface, surface 50C for example, that coincides with the inner edge, edge 44A for example, of the stop member. This configuration also applies to the planar surfaces 50A and 50B of vertical stop members 48A and 48B.

The book binding sequence will now be described, starting with reference to FIG. 8A. The opened hardcover assembly 18 is first positioned on the guide apparatus receiving surface 42, with the upper release liners 36A and 36B facing upwards. As indicated by arrow 52, the hardcover assembly is moved along the surface 42 of the guide apparatus until the edges of cover section 18B is positioned under the ledge member 46, abutting the inner edge 44A of the stop member 44, as shown in FIG. 7. Thus, the outer edge 46A of the ledge member 46 will be positioned a fixed distance X from the edge of cover 18B along the full length of both orthogonal segments of the ledge member 46. The outer edge 46A will provide a guide for positioning the bound stack 10, as will be described.

Once the hardcover assembly 18 is properly positioned on the guide apparatus 40, the user manually separates the upper minor release liner 38B as shown in FIG. 8B from the assembly 18. This will expose a relatively narrow strip of the underlying pressure sensitive adhesive 34B adjacent spine region 26. Next, the bound stack 10 is placed over the upper major release liner 36B, with the edges of the stack engaging edge 46A of the ledge member 46 along both orthogonal segments. FIG. 7 shows the edge of stack 10 engaging edge 46A along one of the two segments. As shown in FIG. 8C by arrows 52, that portion of stack 10 along the exposed adhesive 34B is not placed on the exposed adhesive until the orthogonal edges of the stack are positioned against edge 46A of both segments. Once the correct position is achieved, the stack is forced down upon the exposed pressure sensitive adhesive 34B as shown in FIG. 8D. This operates to secure the folded liner sheet 14A of stack 10 to cover section 18B of the hardcover assembly 18 in a correctly aligned position.

The next step is to secure the remainder of the folded liner sheet 14A of stack 10 to the adhesive 34B of assembly 18. Referring to FIG. 8E, the free edge of stack 10, including liner sheet 14A, is lifted up and rotated away from the upper major release liner 36B. This permits the release liner 36B to be separated from the hardcover assembly 18 thereby exposing the remainder of the pressure sensitive adhesive 34B. As shown in FIG. 8F, the spine portion of stack 10 held down against the hardcover assembly 18 with one hand while stack 10 is rotated over the adhesive 34B with the other hand. As shown in FIG. 8G, the user then presses the stack 10 down on the hardcover assembly 18. This causes the remainder of the liner sheet 14A of the stack to be secured by the remainder of adhesive 34B to cover section 18B of the hardcover assembly 18. The second cover section 18A of the hardcover assembly will now be attached.

Referring to FIG. 8H, the upper minor release liner 38A is next separated from the hardcover assembly 18 thereby exposing a strip of pressure sensitive adhesive 34A adjacent spine region 26. The user then lifts the cover section 18A of the hardcover assembly away from the surface 42 of the guide apparatus and rotates the cover 18A around the spine. As indicated by arrows 54 of FIG. 8I, the cover section 18A is positioned so that the edges of the cover section 18A contact the planar surfaces 50A, 50B and 50C of the respective three vertical stop members 48A, 48B and 48C. This is shown in phantom in FIG. 7. The hardcover assembly 18 is then positioned correctly with respect to the bound stack 10. The user then forces the cover section 18A down as shown in FIG. 8J so that an edge of folded liner sheet 12A of stack 10 is secured to the hardcover assembly 18 by way of the exposed strip of adhesive 34A.

As shown in FIG. 8K, the user then lifts cover section 18A up and rotates the cover away from stack 10, with a narrow strip of liner sheet 12A of the stack remaining secured to cover section 18A. This permits upper major release liner 36A to be separated from hardcover assembly 18 thereby exposing the remainder of pressure sensitive adhesive layer 34A. Cover 18A is then rotated back down onto stack 10, where the edges of the cover should again be in contact with the surfaces 50A, 50B and 50C of the respective stops 48A, 48 and 48C as shown in FIG. 8L by arrows 58. The user then presses down on cover section 18A as shown in FIG. 8M thereby securing the cover section 18A to folded liner sheet 12A of stack 10. This completes the binding sequence.

FIGS. 9A and 9B show the completed book in a closed position and FIG. 10 shows the book in an opened position, at the last page of the book, so that folded liner sheets 14A and 14B are depicted. Sheet 14A is secured to hardcover section 18B by way of adhesive 34B and sheet 12A at the front of the book (not depicted) is secured to hardcover section 18A by adhesive 34A. The region between the binder strip 16 and the spine region 18C is not attached so that, when the book is opened as shown in FIG. 10, the spine region does not attempt to fold with the binder strip 16. Thus, the book will lay flat when opened and will not tend to fold shut. Further, the spine region 18C will not distort when the book is opened to the same degree it would if the spine region 18C was attached. As previously noted, a fairly stiff fabric strip 29 is positioned in the spine region intermediate the gutter regions 28A and 28B (FIG. 3) so as to hold the shape of the spine region 29 when the book is opened and closed. Fold lines 27A and 27B are formed naturally in the membrane 22 in the regions near the edges 25A and 25B of the cover boards thereby further enhancing the appearance of the final product.

Although the prefabricated mass produced cover assemblies 18 of FIG. 3 can be purchased in a wide variety of differing covers (membranes), it would be advantageous to be able to provide custom covers using desktop equipment on demand. The present invention addresses this and other needs relating to the prior art.

SUMMARY OF THE INVENTION

Guide apparatus for forming and applying an over-wrap sheet to a book hardcover is disclosed, with the hardcover including first and second cover sections and a spine section, which the hardcover having a width equal to a sum of a width of the first and second cover sections and the spine section and a length equal to a length of the spine section. The guide apparatus including a base unit having a width greater than the width of the hardcover and a length greater than the length of the hardcover, with the base unit including a hardcover receiving area and first and second orthogonal stops supported on the base unit for engaging first and second respective orthogonal edges of a cut over-wrap sheet.

The guide apparatus further includes third and fourth orthogonal stops supported on the base unit for engaging first and second orthogonal edges of a hardcover placed on the hardcover receiving area. The third stop is substantially parallel to the first stop and disposed intermediate a center of the hardcover receiving area and the first stop and the fourth stop is substantially parallel to the second stop and disposed intermediate the center of the hardcover receiving area and the second stop, with the third and forth stops extending a distance away from the base unit less than a distance that the first and second stops extend away from the base unit so that the first and second stops do not interfere with placement of the over-wrap sheet over the hardcover and abutting the first and second stops. A reticule is included which is disposed on the base unit for aligning the base unit over an over-wrap sheet.

DETAILED DESCRIPTION OF THE INVENTION

Figure 1:
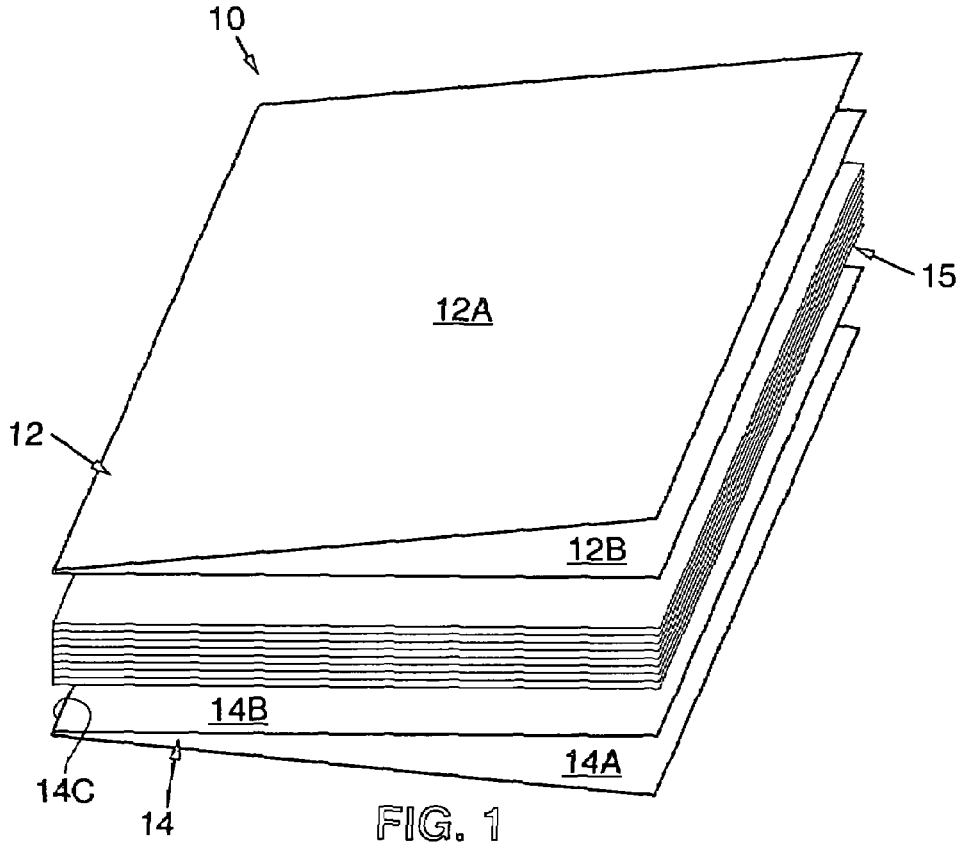
FIG. 1 (PRIOR ART)
FIG. 1 is a perspective view of a stack of sheets to be bound, including the front and back folded liner sheets as per the prior art.
Figure 2:
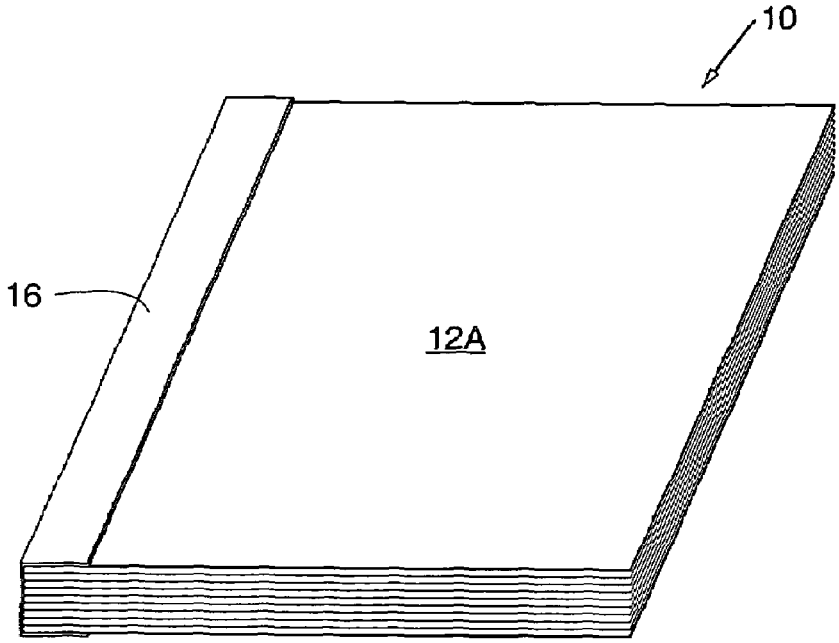
FIG. 2 (PRIOR ART)
FIG. 2 is a perspective view of the stack of sheets of FIG. 1 after binding using a conventional binder strip as per the prior art.
Figure 3:
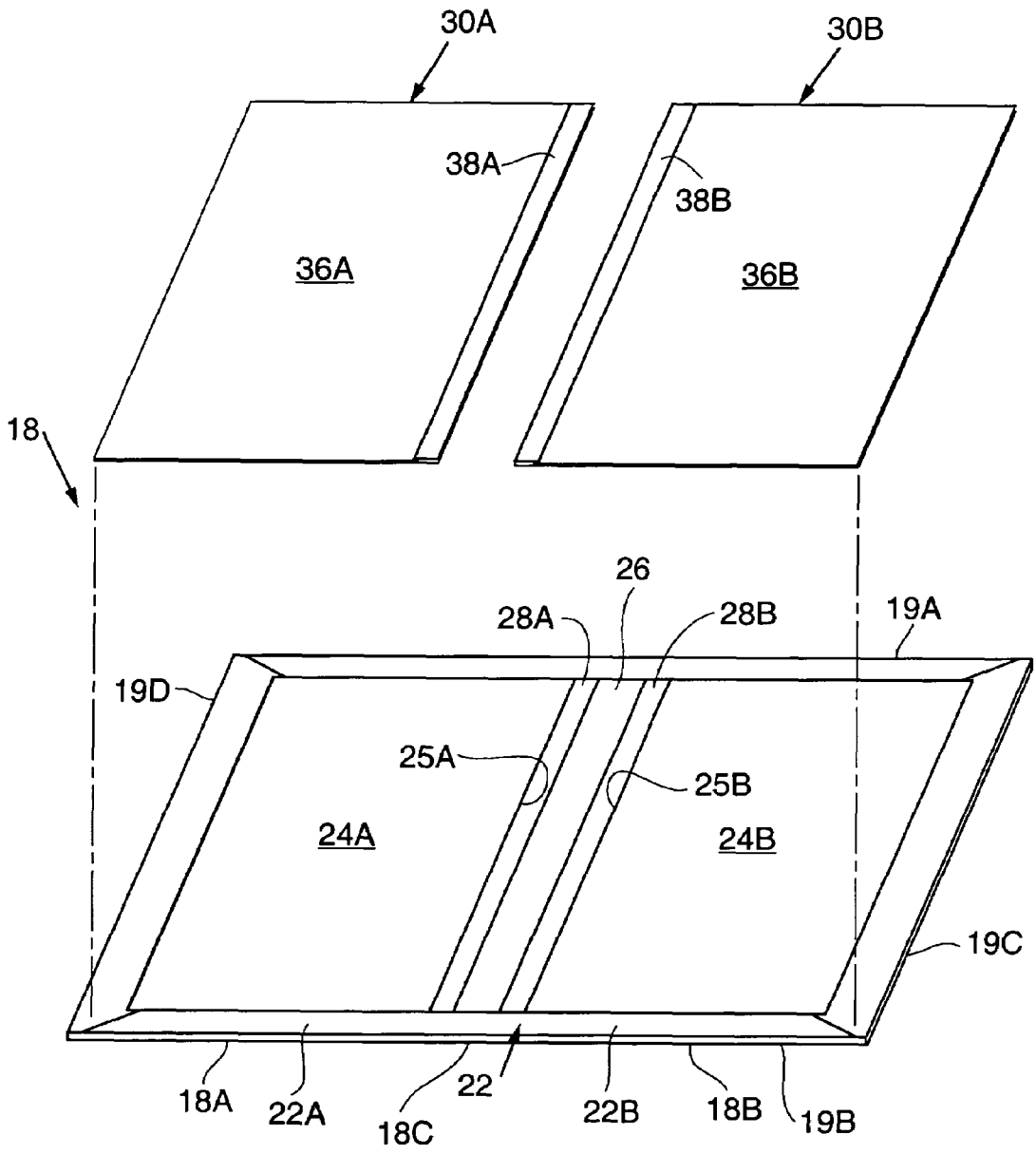
FIG. 3 (PRIOR ART)
FIG. 3 is a perspective exploded view of a prior art hardcover assembly, with the pressure sensitive front and rear sheets structures shown displaced from the remainder of the assembly.
Figure 4:
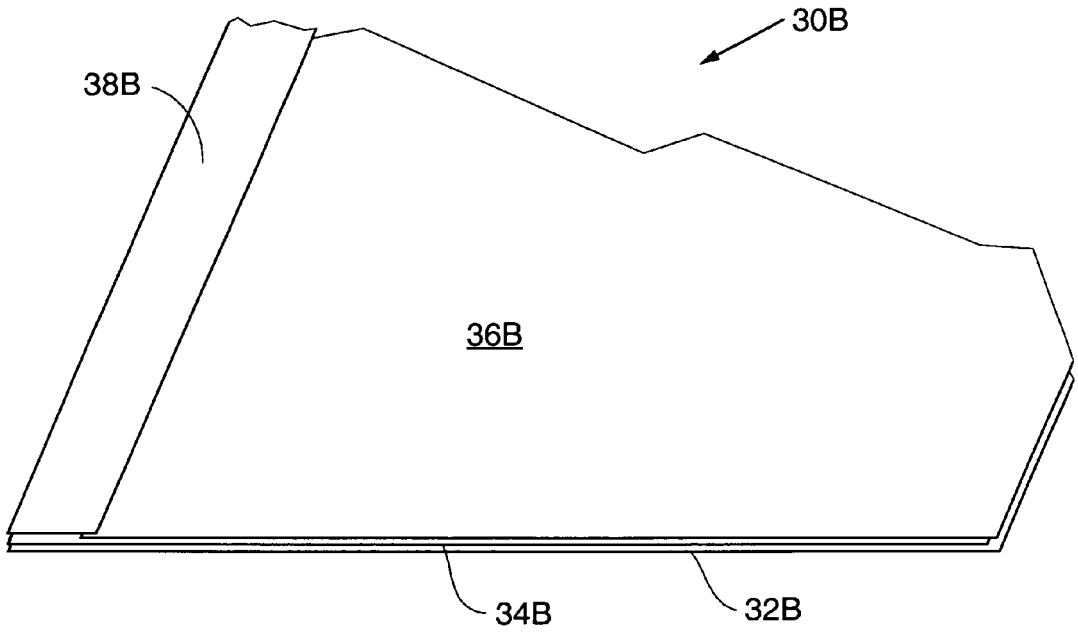
FIG. 4 (PRIOR ART)
FIG. 4 is a perspective view of one of the two prior art pressure sensitive adhesive sheet structures.
Figure 5:
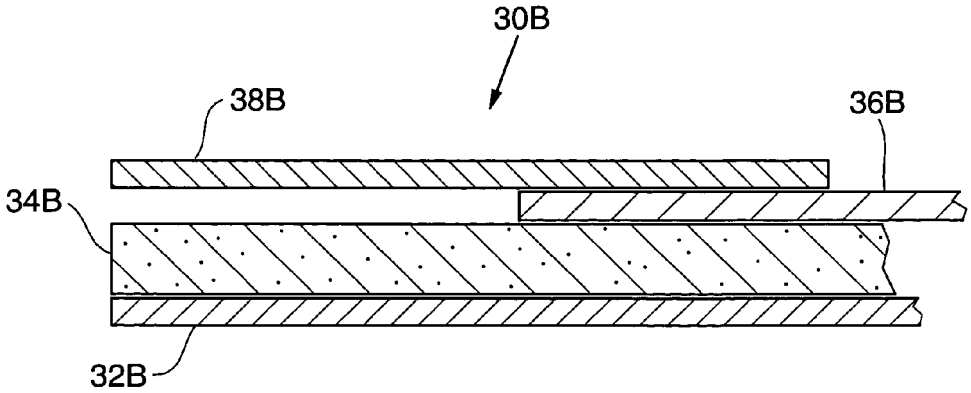
FIG. 5 (PRIOR ART)
FIG. 5 is a cross-section elevational view of a portion of the adhesive sheet structure of FIG. 4.
Figure 11:
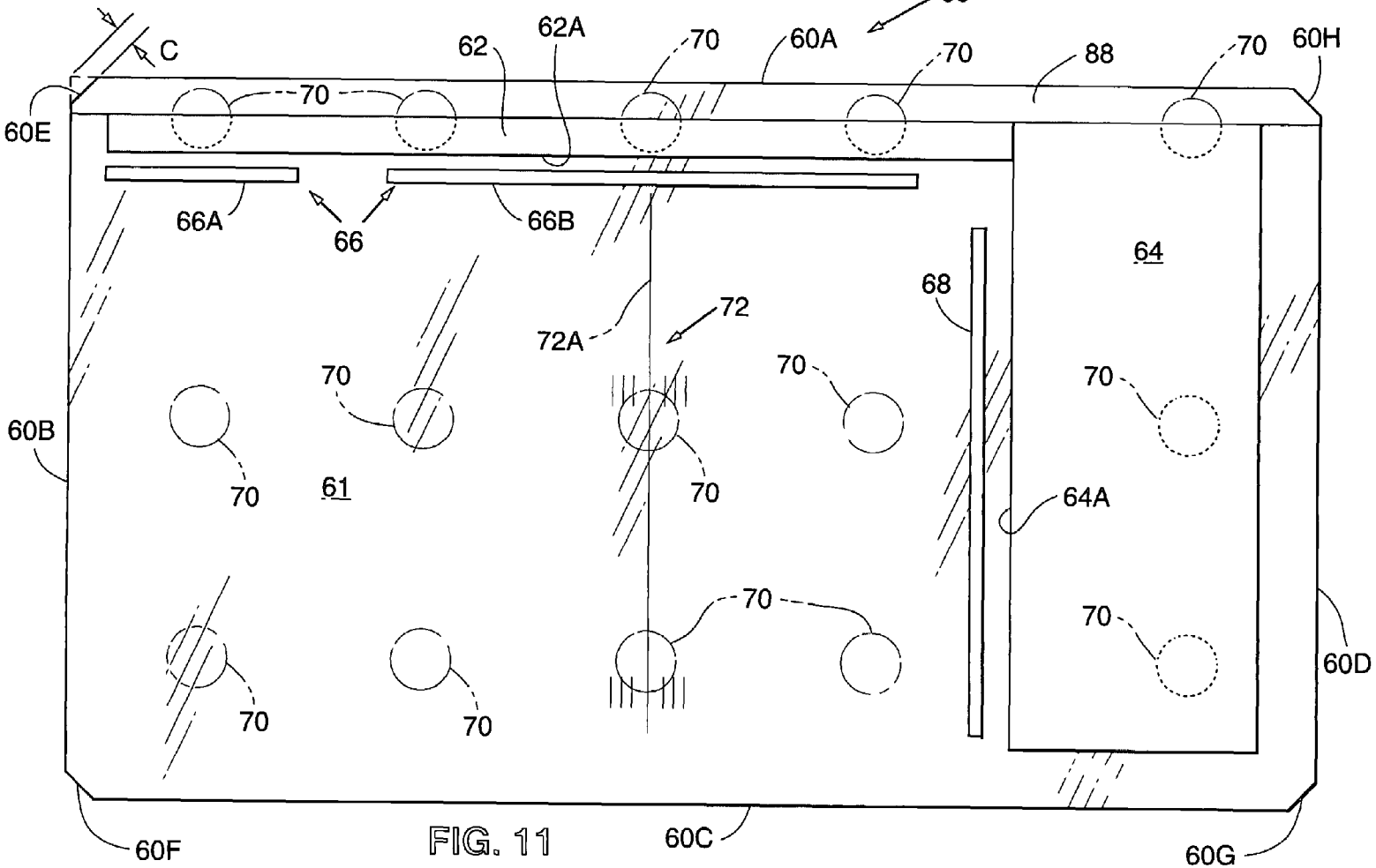
FIG. 11 is a plan view of an over-wrap guide in accordance with one aspect of the present invention.
Figure 12:
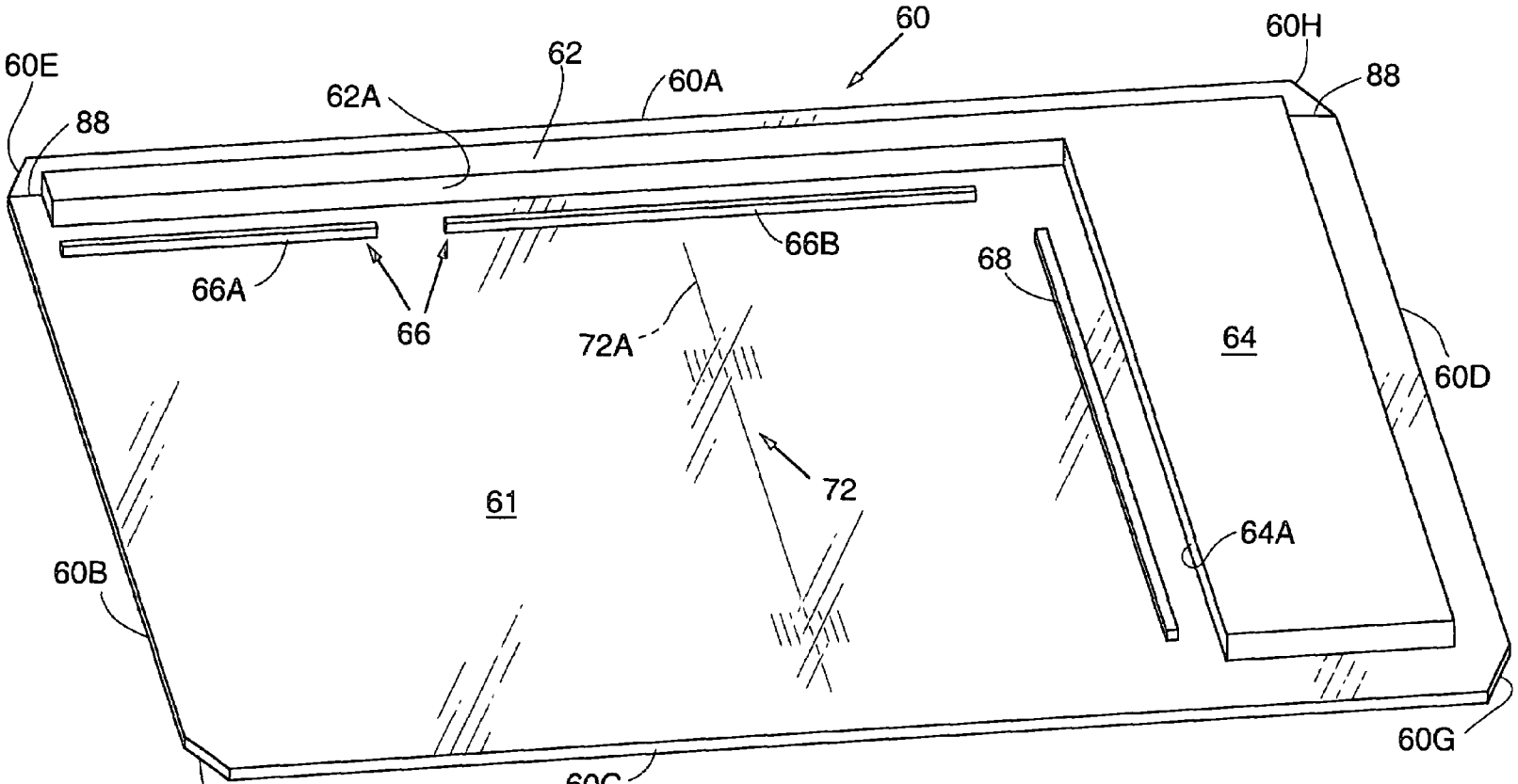
FIG. 12 is a perspective view of the over-wrap guide of FIG. 11.

Referring again to the drawings, FIG. 3 shows a prior art hardcover assembly 18 having a plain cover which can be covered with a custom over-wrap sheet fabricated on demand and applied to the hardcover in accordance with the present invention using desktop equipment. FIGS. 11 and 12 depict an over-wrap guide 60 in accordance with one aspect of the subject invention which is used to align, cut and apply the over-wrap sheet to the hardcover. The over-warp guide 60 is, among other things, used as a template for cutting the over-wrap sheet to the size appropriate for a particular format book such as 8½ by 8½ inches. Although the exemplary dimensions set forth below are applicable for the 8½ by 8½ format, the present description of the invention enables one of ordinary skill to select guides of appropriate dimensions to accommodate other formats.

The guide 60 includes a base 61 that is preferably made of transparent acrylic plastic such as Plexiglas brand plastic. For 8½ inch by 8½ inch format books, the base 61 should have a length of approximately 18.75 inches in length, with a width of approximately 9.4 inches. The four chamfered corners 60E, 60F, 60G and 60H of the base 61 are cut at 45 degrees to facilitate wrapping of the cut over-wrap sheet around the corners of the hardcover, as will be described later. As can be seen at corner 60E, there is a distance C measured from the virtual corner of the base to the 45 degree cut which is about 0.3 of an inch for each corner.

The over-wrap guide 60 includes a reticule 72 for aligning the guide with respect to title or other printed information present on the uncut over-wrap sheet. The guide preferably includes a guide-marking array, including reticule 72, which is shown more completely in FIG. 29, with the major and minor stops 66 and 68 not being depicted in FIG. 29 for purposes of clarity. Reticule 72 includes a centerline mark 72A and minor markings (not designated) displaced from the centerline mark for use in aligning the guide over large font or multi-line text. The additional guide lines that make up the guide-marking array shown in FIG. 29 will be discussed later. Guide 60 further includes a pair of orthogonal major stops 62 and 64, having respective edges 62A and 64A, which are supported on the base 61. Stop 64 is about 8 inches long and stop 62 is about 13 inches long. Edges 64A and 62A of the major stops are used to align the cut over-wrap sheet 80 over the hardcover assembly 18 as will be described. The guide 60 further includes a pair of minor orthogonal stops 66 and 68, with stop 66 being broken into two separate segments 66A and 66B. The minor stops 66 and 68 are used to position the hardcover assembly on the over-wrap guide 60. The minor stops 66 and 68 extend up from the base 61 a relatively short distance, typically only about ⅛ of an inch, as compared to the major stops 64 and 62 which extend up about ¼ of an inch. This permits the minor stops 66 and 68 to be used to align the hardcover assembly on the base without interfering with the placement of the cut over-wrap sheet over the hardcover and abutting the major stops 62 and 64.

Minor stop 68 is typically about 6.5 inches long, with minor stop segment 66B being about 7½ inches long and with minor stop segment 66A being about 3 inches long. The gap between the minor segments 66A and 66B, which is about 1¾ inches long, is present to accommodate the edges of spine section 18C of the hardcover assembly which tend to extend slightly past the edges 18A and 18B. The gap ensures that the edges of the minor stops 66A and 66B abut the appropriate edges of the hardcover assembly, without interference from the spine region material of the assembly. There is also a gap between the adjacent edges of minor stop segments 66B and 68 so as to accommodate the small amount of material that sometimes extends past the edges of the hardcover assembly 18 near the corners of the assembly.

The spacing between the edges of the minor stops 66 that engage the hardcover assembly edges and the edge 62A of the major stop which engages the edge of the cut over wrap sheet 80 defines the size of the wrap sheet overhang which will be wrapped around the edges of the hardcover assembly 18. The same is true of the spacing between the hardcover engaging surface of minor stop 68 and the edge 64A of major stop 64. These spacings are both about 0.3 inches. Several soft rubber anti-skid cushions 70, not shown in FIG. 12, are further disposed on the lower surface of the base 61 to secure the guide in place on the over-wrap sheet 80 while the sheet 80 is being cut. The back row of cushions are positioned relative to a rear step 88 so to prevent the guide 60 from flipping up when the step is used for folding edges of the wrap sheet 80 around the edges of the hardcover assembly 18, as will be described. Rather than having separate anti-skid cushions 70, it is also possible to apply an anti-skid coating to all or part of the lower surface of the base 61 in order to increase the coefficient of friction between the base 61 and the underlying over-wrap sheet.

Referring again to FIG. 29, the complete guide-marking array present on transparent base 61 further includes four guide lines 98A, 98B, 98C and 98D which form a rectangle inside the periphery of the base 61. Guide lines 98A, 98B, 98C and 98D are parallel to respective guide edges 60A, 60B, 60C and 60D and are each spaced about 0.3 inches from the guide edges. Lines 98B and 98D are parallel to center line 72A, with lines 98A and 98C being normal to the center line 72A. The approximate 0.3 inch spacing defines the amount of over-wrap 80 after cutting that will be folded over and around the respective edges of the hard cove assembly 18.

Figure 13:
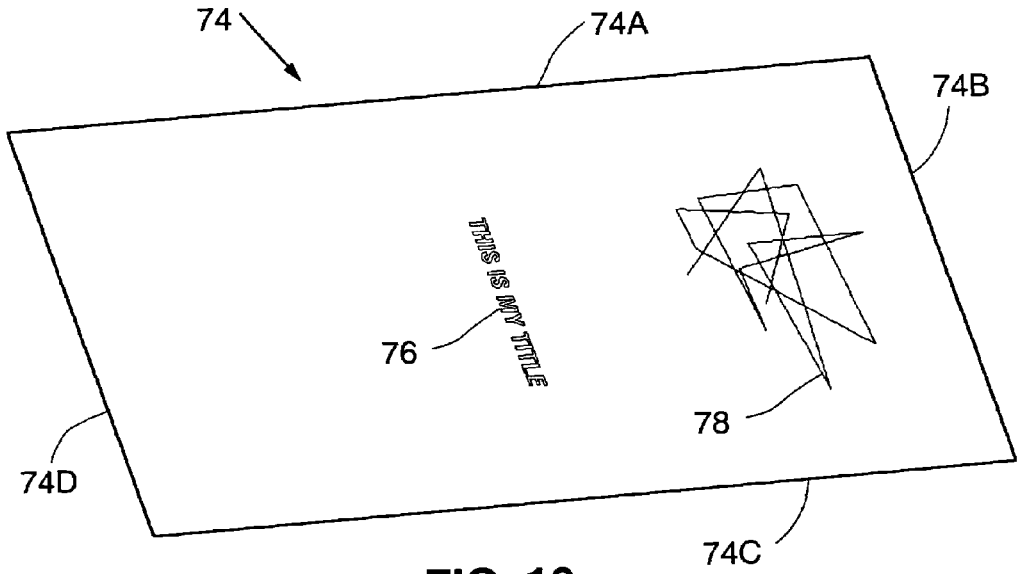
FIG. 13 is a perspective view of an uncut over-wrap sheet in accordance with one aspect of the present invention.

The guide marking array further includes a guideline 102, normal to center line 72A, that extends across the center of base 61 between, and is equidistant from, lines 98A and 98C. A second guide line 104A, parallel to center line 72A extends between, and is close to halfway between center line 72A and guide line 98B. A third guide line 104B, also parallel to center line 72A, is close to being halfway between center line 72A and guide line 98D. When the guide 60 is used as a template for cutting, over-wrap sheet 74, reticule 72 is used to align the guide 60 over the printed information that is located on the spine, typically title information 76 as shown in FIG. 13. Outer guide lines 98A, 98B, 98C and 98D define the extremities of the region of the over-wrap sheet that will appear on the outer surface of the hard cover and thus can be used as further placement guide. Guide lines 102 and 104A form a first cross hair having a center point 100B for locating what will be the visual center of the back cover, with guide line 104B and guide line 102 forming a second cross hair having a center point 100A for locating the visual center of the front cover on the over-wrap sheet.

The uncut over-wrap sheet 74 (FIG. 13) is preferably made of well known materials suitable for covering a hardcover book including, for example, composition material, art or library cloth or photographic paper. The back of the over-wrap sheet includes a layer of pressure sensitive adhesive covered by two release liners, each of which covers only a portion of the adhesive. Printed spine information, typically title information 76, in addition to cover art or other printed information 78 can be printed on the uncut over-wrap sheet 74 using large format desktop inkjet or laser printers.

Figure 14:
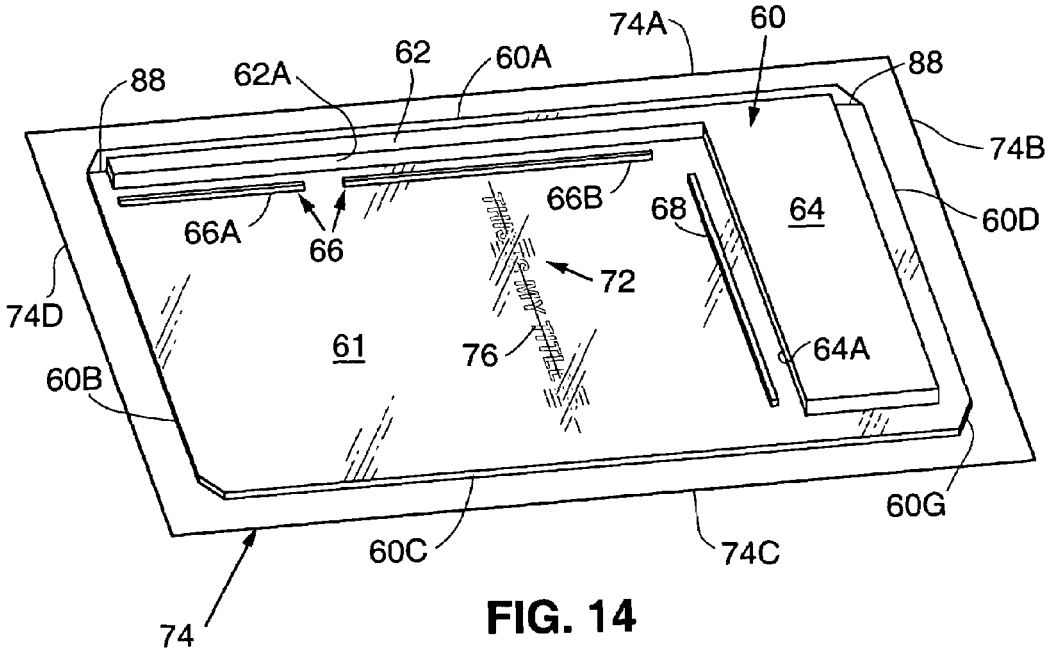
FIG. 14 is perspective view of the over-wrap guide positioned over an uncut over-wrap sheet.
Figure 16:
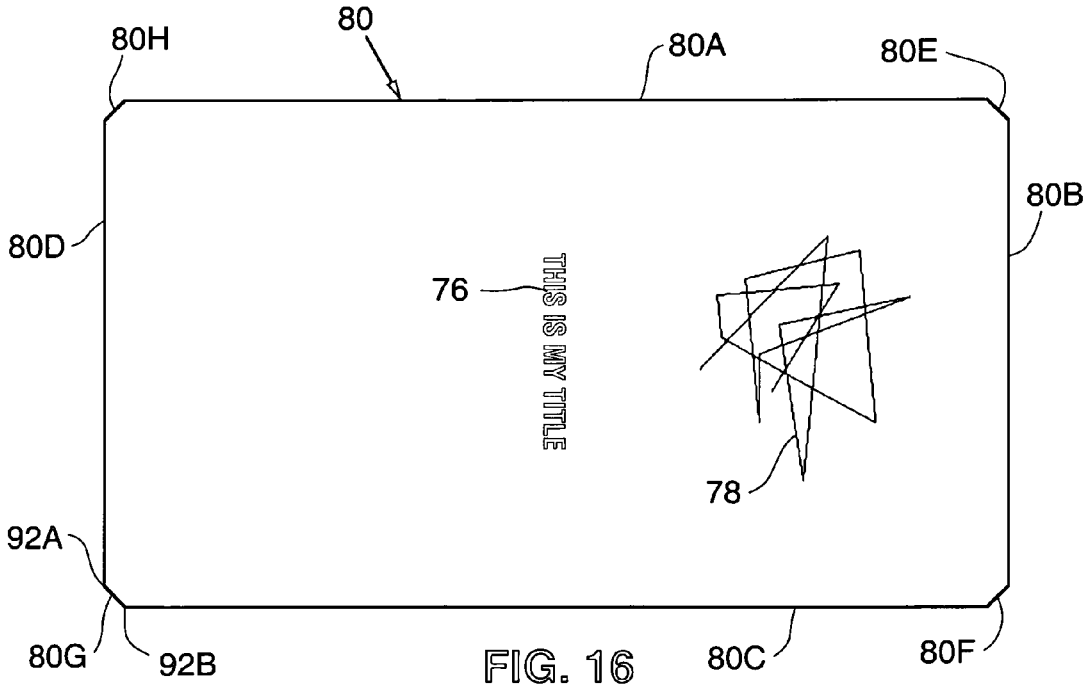
FIG. 16 is a plan view of the over-wrap sheet after cutting.

Once the printing on the uncut over-wrap sheet 74 has been completed, the over-wrap sheet is cut to the proper size using the over-wrap guide 60 as a template, as previously noted. As can be seen in FIG. 14, the uncut over-wrap sheet 74 is positioned on a cutting board (not depicted) with the printed side up. The guide 60 is placed over the over-wrap sheet 74 with the reticule 72 being aligned through the transparent base 61 with the title or other related printed information that will be on the spine of the bound book. The two center points 100A and 100B (FIG. 29) can be used to assist in the alignment so that any art work 78 (FIG. 13) or other matter printed on the wrap-sheet can be centered on the front or back cover of the hardcover assembly. All printed matter must fall within the rectangle (FIG. 29) formed by lines 98A, 98B, 98C and 98D if such matter is to appear on the front, back and spine regions of the hard cover assembly 18. Printing beyond those extremities would wrap around the edge of the cover. Once the guide 60 has been properly aligned, the uncut over-wrap sheet should be of a sufficient size so that at least some portion of the over-wrap sheet 74 extends past the entire of periphery of the guide as shown in FIG. 14. The user then holds the guide in place with one hand, with the aid of the anti-skid cushions 70. A knife held in the other hand is then used to cut the over-wrap sheet 74 around the periphery of the guide 60, using the guide as a template. The cut over-wrap sheet 80, as shown in FIG. 16, is then set aside.

Figure 15:
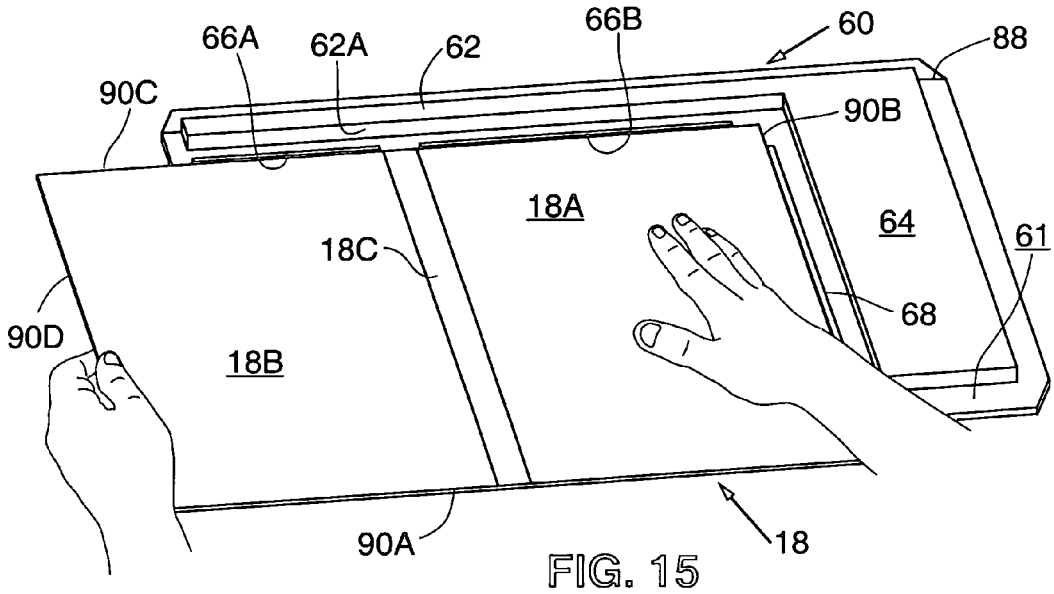
FIG. 15 shows a prior art hardcover assembly being positioned on the receiving area over-wrap guide.

A hardcover assembly, such as assembly 18 of FIG. 3, is then positioned on the base 61 with the exterior of the assembly outer cover facing the user as shown in FIG. 15. The hardcover assembly is positioned so that a first edge 90B is abutting minor stop 68. A second edge 90C, normal to the first edge 90B, is positioned abutting minor stops 66, including stop segments 66A and 66B. As can be seen, spine region 18C of the hardcover assembly falls in the gap between minor stops 66A and 66B, with the corner of the assembly falling within the gap between stops 66B and 68.

Figure 19:
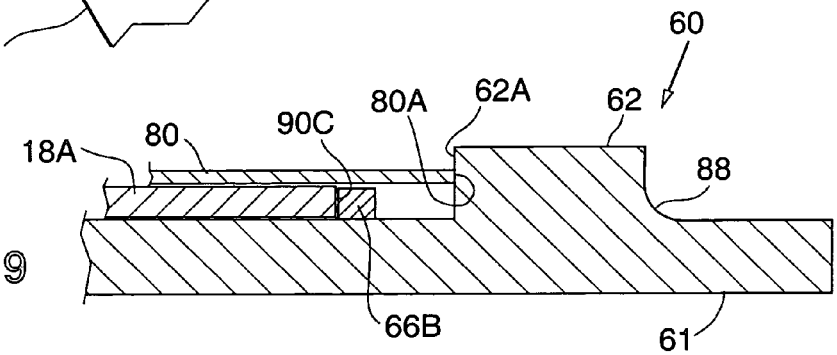
FIG. 19 is an elevational sectional view showing a portion of the over-wrap disposed on over-wrap guide over the hardcover apparatus.
Figure 18:
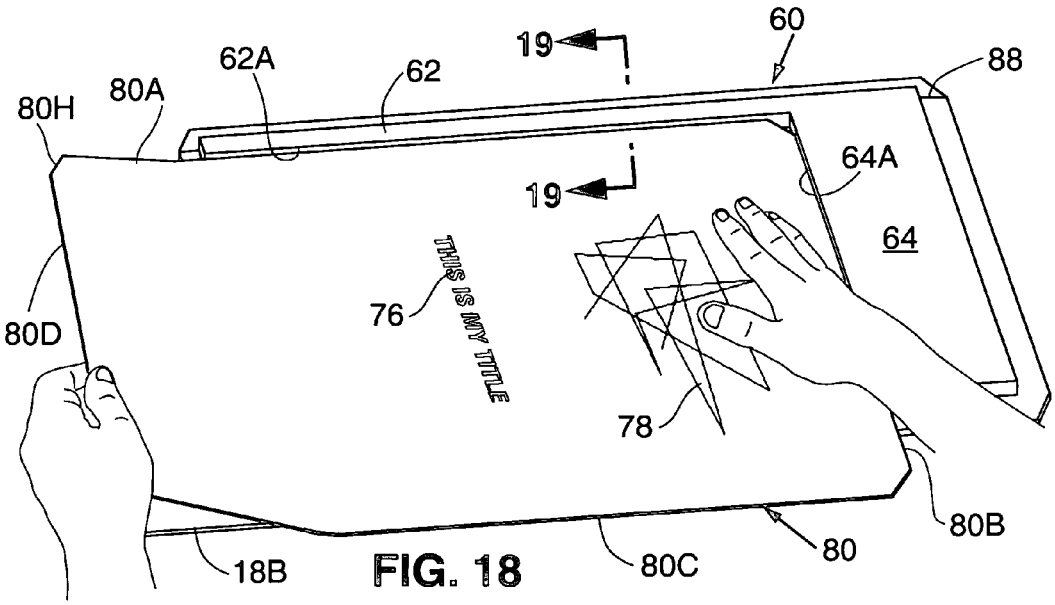
FIG. 18 shows the cut over-wrap sheet being positioned over the hardcover assembly located in the over-wrap guide.
Figure 29:
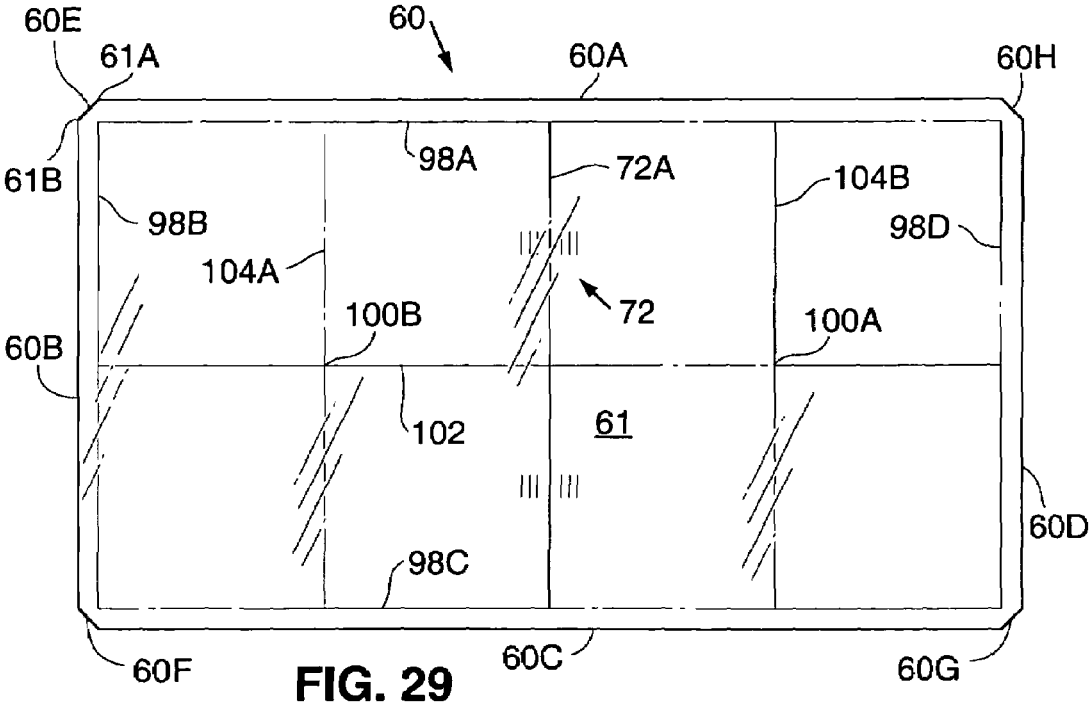
FIG. 29 is a plan view of base of the over-wrap guide, with the minor and major stops not depicted, showing a guide-marking array used to align the guide over the uncut over-wrap sheet.

Next, the cut over-wrap sheet 80 (FIG. 16) will be positioned over the hardcover assembly 18, but after one of the release liners is removed as will be described below. Sheet 80 is positioned as shown in FIG. 18, with over-wrap edge 80B abutting edge 64A of major stop 64 and with over-wrap edge 80A abutting edge 62A of major stop 62. As can be seen in FIG. 19, the spacing between the surface of the minor stop 66B abutting edge 90C of the hardcover section 18A and the surface 62A of the major stop 62 abutting the edge 80A of the over-wrap sheet 80 corresponds to the over-wrap sheet overhang. This dimension also corresponds to the approximately 0.3 inch spacing between guide line 98A and guide edge 60A as shown in FIG. 29. The spacing of the inner edge of minor stop 68, which abuts edge 90B of the hard cover assembly 18 and inner edge 64A of major stop 64 also corresponds to the desired approximately 0.3 of an inch overhang as also indicated by the spacing between line 98D and guide edge 60D of FIG. 29. Although not visible to the user at this point, the cut over-wrap sheet 80 will be positioned over the hardcover assembly 18 to coincide with the rectangle defined by guide lines 98A, 98B, 98C and 98D. Thus, with the cut over-wrap sheet 80 so positioned, the remaining two edges 80C and 80D will also have the desired approximately 0.3 inch overhang.

Figure 17:
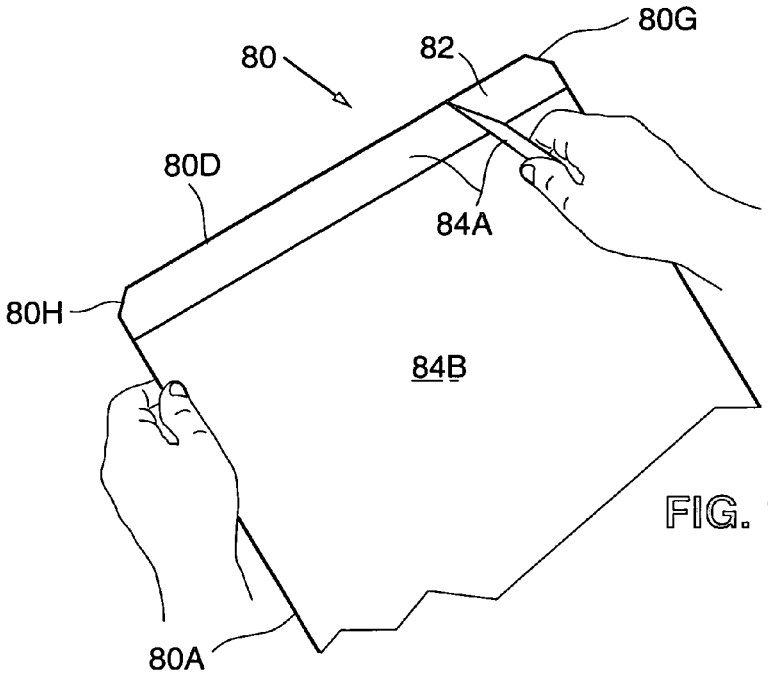
FIG. 17 shows the opposite side of the over-wrap sheet of FIG. 16 with one of the release liners being removed.
Figure 20:
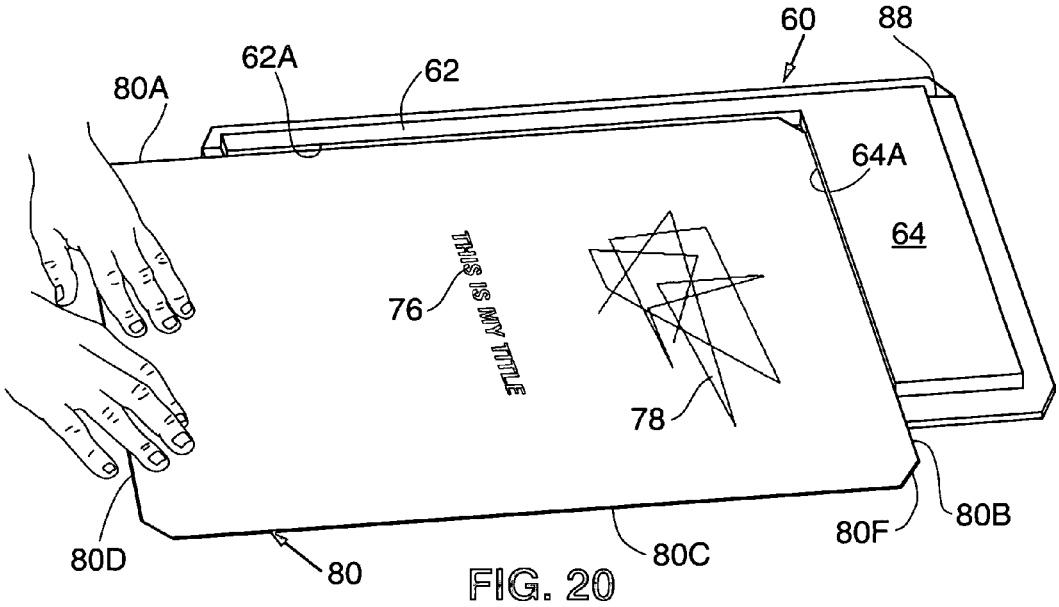
FIG. 20 shows the cut over-wrap sheet being applied to the hardcover assembly.

Prior to the placement of the over-wrap sheet 80, the user removes release liner 84A (FIG. 17) of the over-wrap sheet 80 thereby exposing pressure sensitive adhesive 82, leaving release liner 84B in place. Release liner 84A covers adhesive in the region near edge 80D of the over-wrap sheet 80. The user then accurately positions the cut sheet on the guide 60 as shown in FIG. 18, with sheet edges 80A and 80B abutting respective major stop edges 62A and 64A, in a manner such that the exposed pressure sensitive adhesive 82 does not contact the hardcover assembly at this point. The user then places a right hand on sheet 80 as shown in FIG. 18 to hold the sheet in place and then places the left hand (not depicted) on the sheet, just to the left of the right hand. The user then moves the left hand over the surface of the sheet so that the exposed adhesive 82 is pressed against the hardcover in the region near edge 80D of the sheet. This action secures the over-wrap sheet 80 and the cover assembly together at one location thereby maintaining the proper alignment of the sheet on the cover assembly 18. As shown in FIG. 20, the user can then use both hands to press the sheet against the hardcover in the region of the exposed adhesive.

Figure 22:
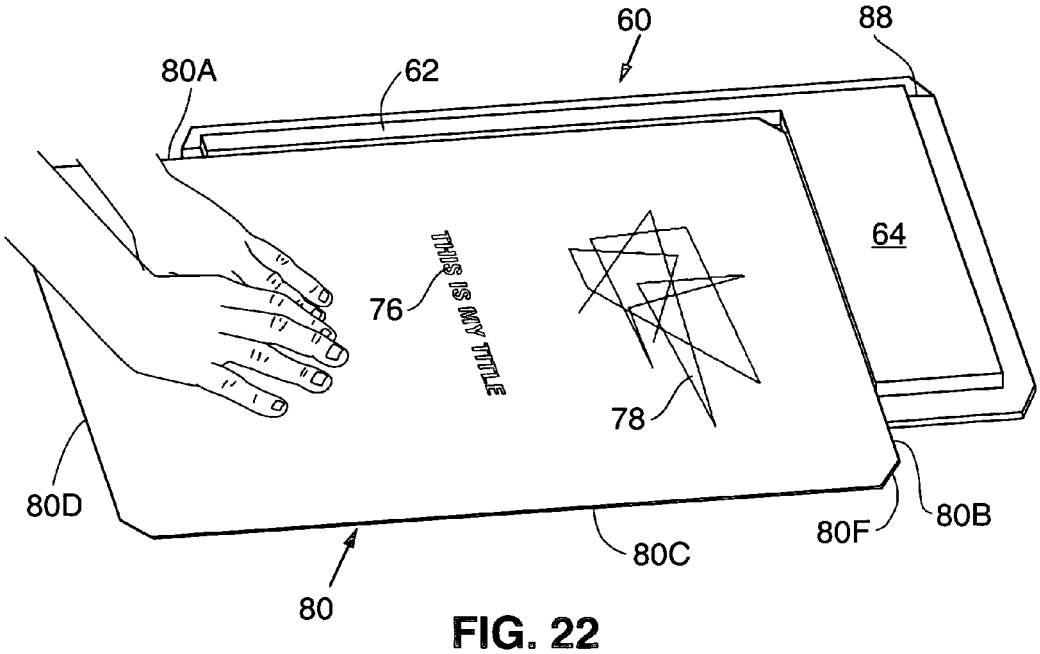
FIG. 22 shows the over-wrap sheet being pressed against the hardcover assembly.
Figure 21:
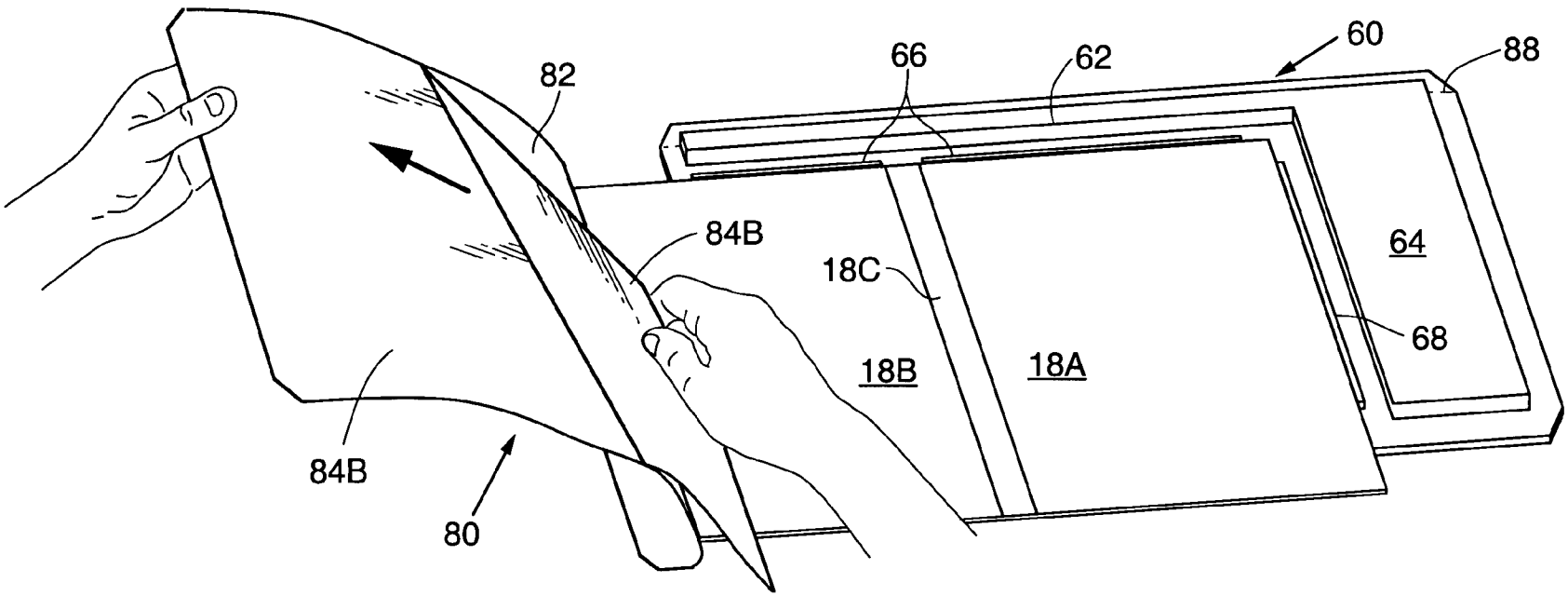
FIG. 21 shows the removal of the second release liner from the over-wrap sheet after the first release liner has been removed.

As shown in FIG. 21, the user can then lift the unsecured end of the over-wrap sheet 80 away from the hardcover assembly 18, without disturbing the adhered portion, to provide access to the remaining release liner 84B. The release liner 84B is then removed thereby exposing the remainder of the pressure sensitive adhesive 82. With the loose end 80B of the sheet 80 held in the right hand, the user moves the left hand across the surface of the sheet starting at secured edge 80D and moving towards free edge 80B, forcing the sheet down against the hardcover assembly as the hand is moved thereby preventing the formation of air pockets. This action causes the over-wrap sheet 80 to be secured to the hardcover assembly along the entire length of the assembly. The user can then use both hands to further press the sheet 80 against the hardcover as shown in FIG. 22 thereby ensuring that the sheet is fully adhered to the exterior portion of the hardcover assembly 18.

Figure 23:
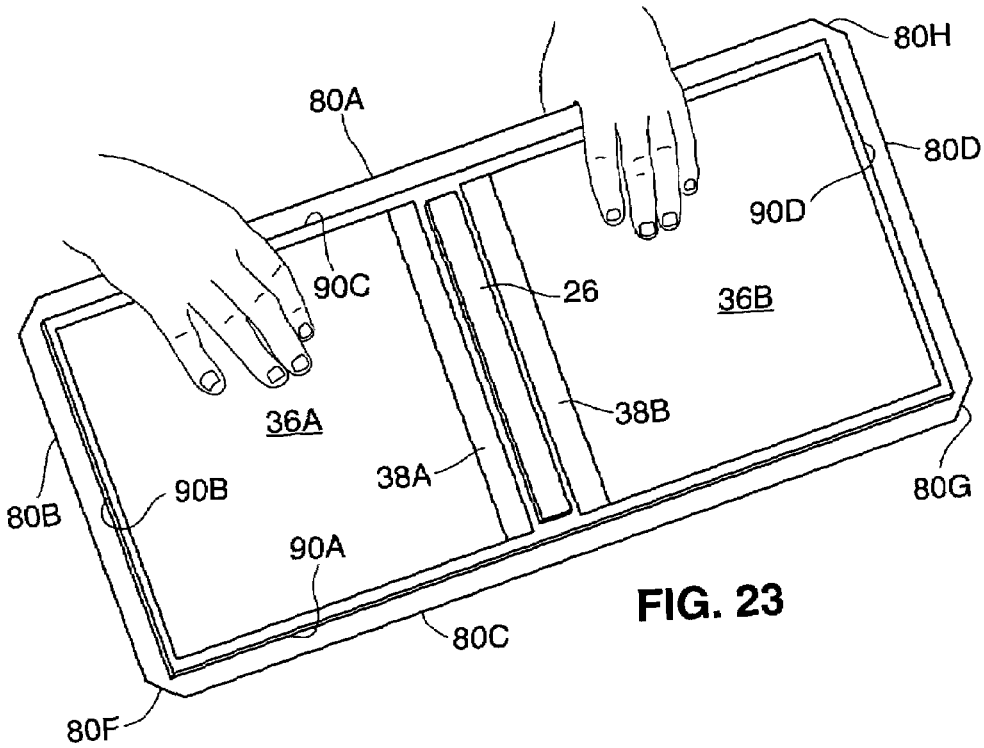
FIG. 23 shows the inner side of the hardcover assembly after the over-wrap sheet has been applied, with the edges of the over-wrap sheet extending past the edges of the hardcover assembly.
Figure 24A:
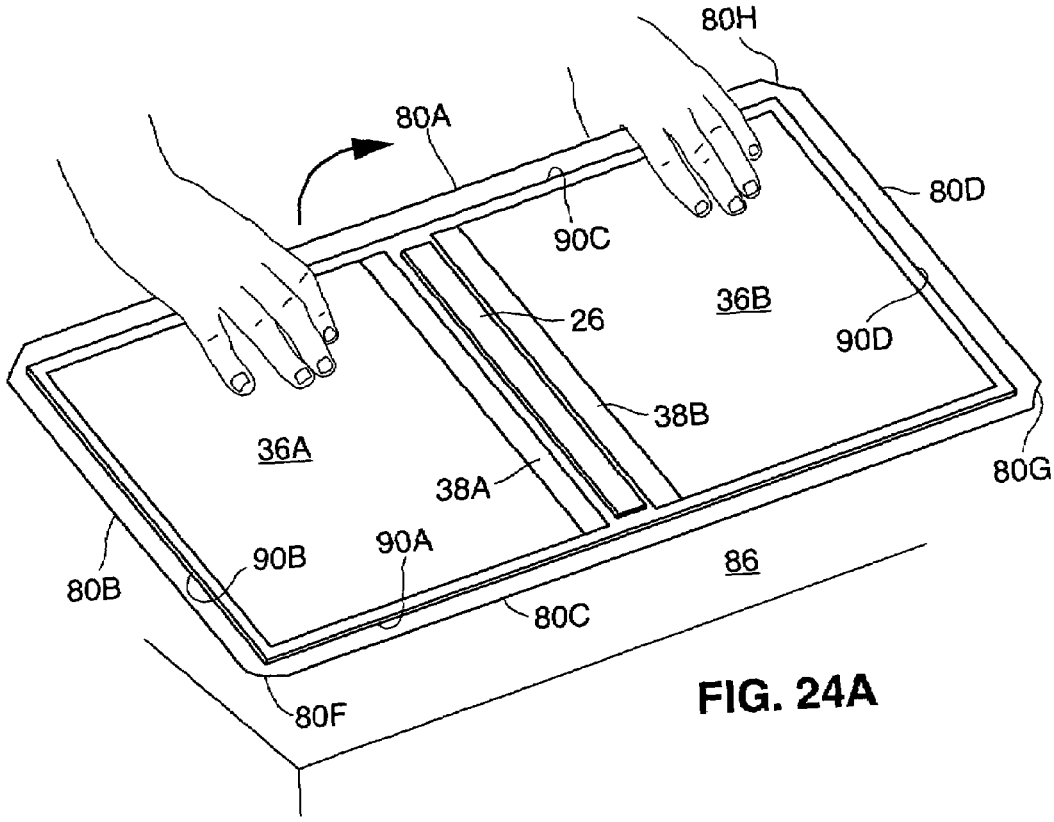
FIGS. 24A, 24B and 24C show one procedure for wrapping the long edges of the over-wrap sheet around the edges of the hardcover assembly.
Figure 24B:
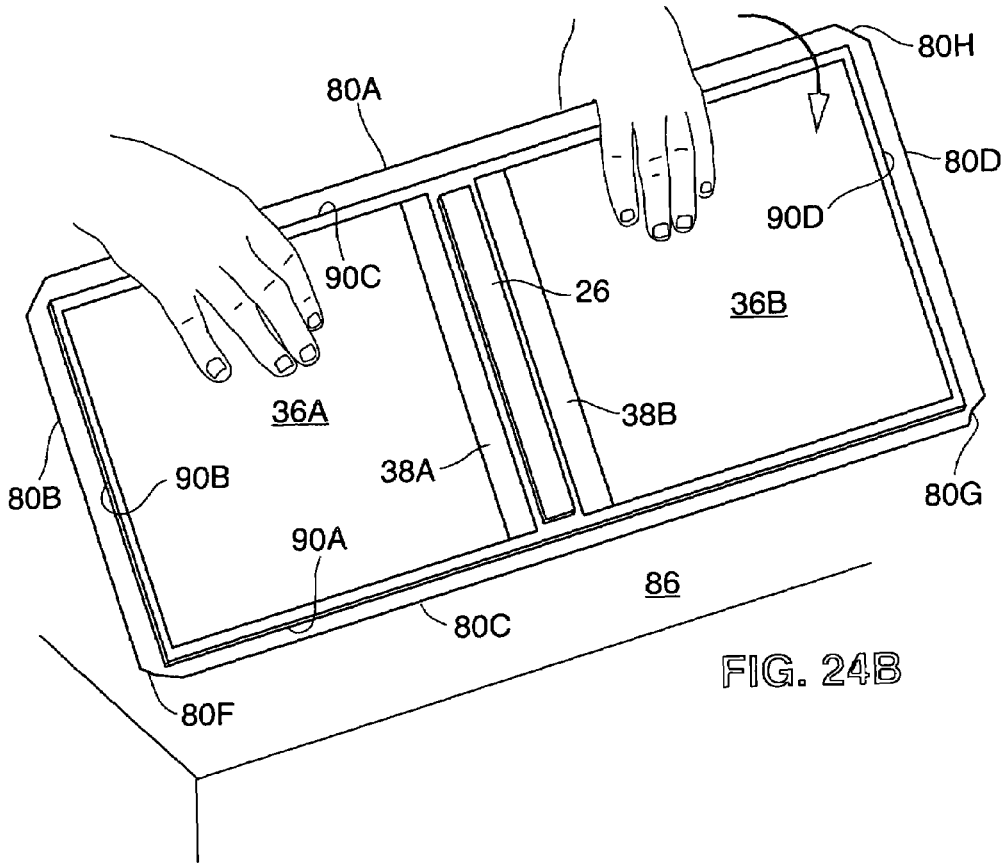
Figure 24C:
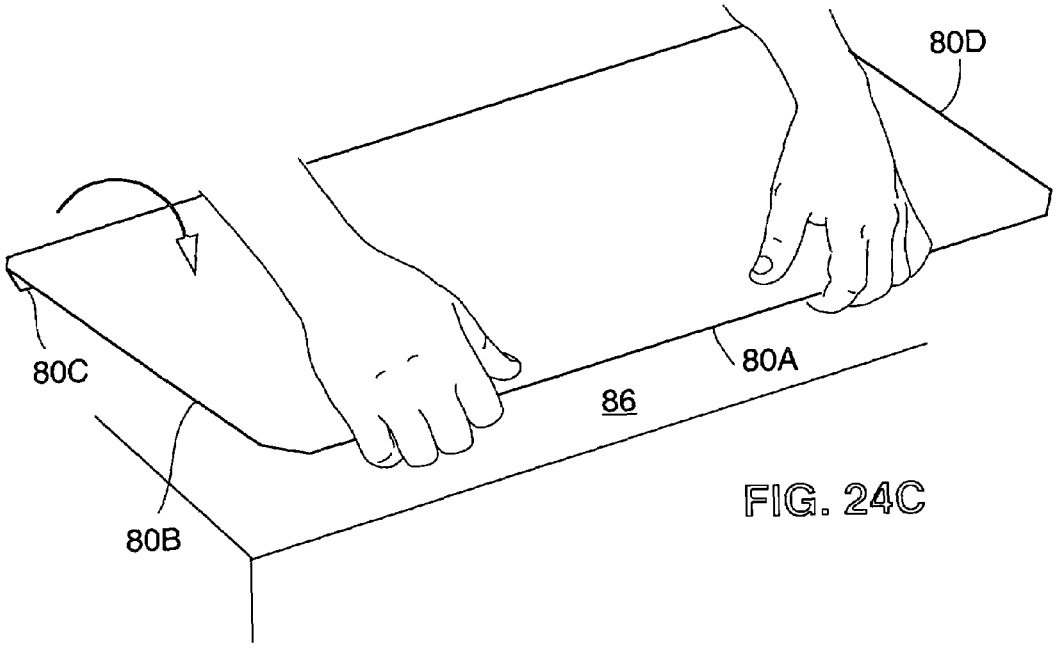

The overhanging edges of the over-wrap sheet 80 are then folded around the edges of the hardcover assembly 18 and secured in place by the exposed pressure sensitive adhesive. Two exemplary alternative approaches are described. In the first approach, the user lifts the assembly 18 with attached sheet 80 from the guide 60 and holds the combination as shown in FIG. 23. As shown in FIG. 24A, the user positions the combination on a table 86, with one of the longer edges of the hardcover assembly 18, such as edge 90A and the underlying sheet 80 overhang near edge 80C, pressed against the surface of the table. The user then rotates the free end of the combination up, while continuing to force edge 90A and sheet overhang against the table surface as shown in FIG. 24B thereby wrapping the sheet 80 near edge 80C around edge 90A of the assembly. As shown in FIG. 24C, the user continues rotating the combination over the table surface while forcing edge 90A down thereby continuing the wrapping sequence. This technique ensures that the wrapping is uniform along the entire length of hardcover assembly edge 90A. The process is then repeated for opposite long edge 90C of the hardcover assembly, leaving edges 90B and 90D unwrapped.

Figure 26A:
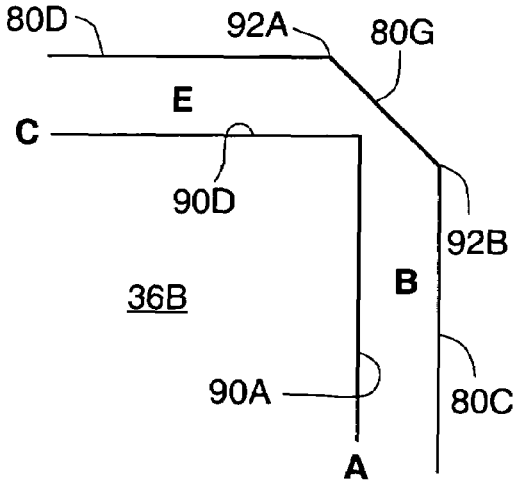
FIGS. 26A, 26B, 26C and 26D show the sequence for folding the over-wrap sheet over the hardcover corners.
Figure 26B:
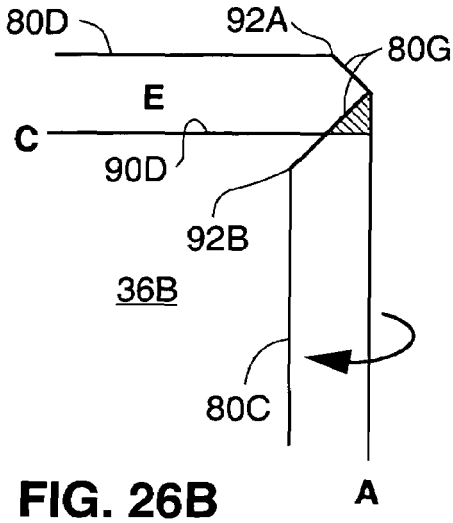
Figure 26C:
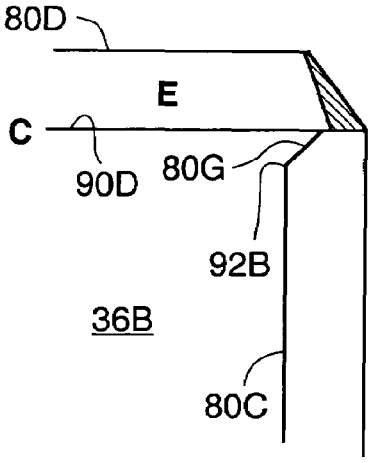
Figure 26D:
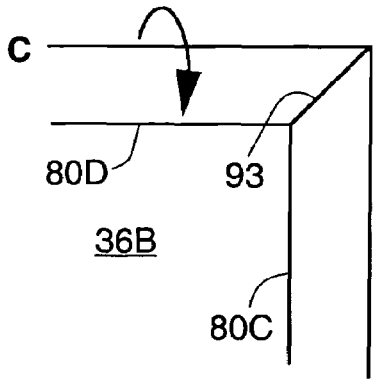
Figure 28:
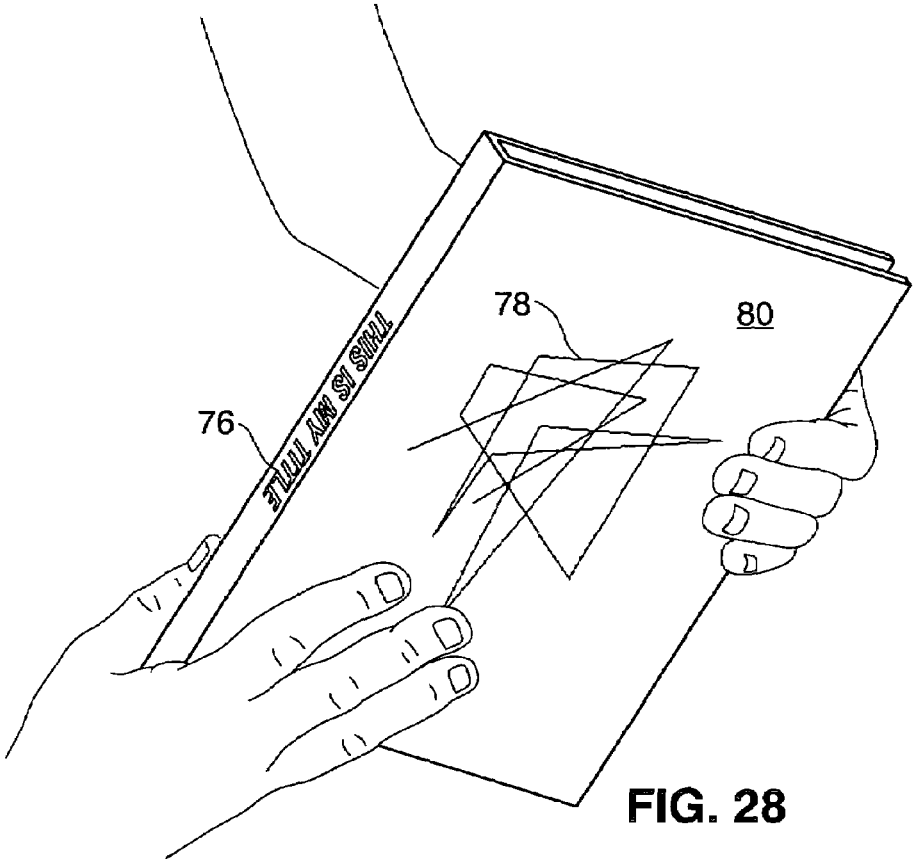
FIG. 28 shows the covered hardcover assembly prior to application of the assembly to a bound stack.

The next step is wrapping end edges 80B and 80D of the sheet around the hardcover assembly 18. In doing so, the user completes the formation of the wrapped corners of the hardcover book. FIG. 26A shows the first step in wrapping one of the corners, the exemplary corner 80G where edges 80C and 80D of the sheet meet along with edges 90A and 90D. As shown, letter A represents the location of edge 90A of the hardcover assembly 18 and letter C represents the location of edge 90D. As also shown in FIG. 26A, the overhang represented by the letter B flap at edge 80C of the over-wrap sheet was first folded around edge 90A as previously described in connection with FIGS. 24A, 24B and 24C. This creates the approximate arrangement shown in FIG. 26B, with such arrangement not yet being secured in place by the pressure sensitive adhesive. This is because the folded portion of the sheet located at the shaded area of FIG. 26B remains separated form the underlying sheet, represented by the letter E, with such separation being due primarily to the thickness of the cover board 24B (FIG. 3). The user then presses down on the shaded region of the over-wrap sheet shown in FIG. 26B so that the adhesive backing on the upper and lower portions of the folded sheet are adhered to one another. In doing so, the upper layer of the over-wrap sheet is pressed down, preferably with the user's finger nail, in a manner such that the sheet conforms to the vertical portion of edge 90D of the hardcover assembly. The resultant structure is shown in FIG. 26C. Finally, as shown in FIG. 26D, the user folds that portion of the sheet at edge 80D around edge 90D, with this fold being secured by the underlying adhesive. This results in an attractive folded corner having a seam 93 that is partially at 45 degrees with respect to edges 80D and 80C and which terminates at the corner. This folding process is repeated for the remaining corners and edge 80B. The final hardcover assembly, covered in over-wrap sheet 80, is shown in FIG. 28. The hardcover assembly can then be used to cover a bound stack of sheets as described in connection with FIGS. 8A-8M.

Figure 25:
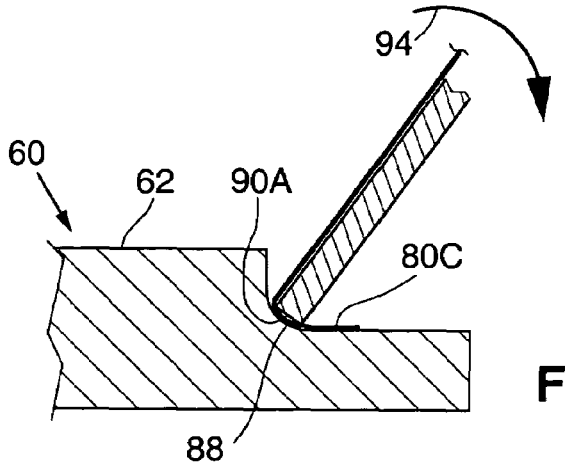
FIG. 25 shows a second procedure for wrapping the edges of the over-wrap sheet around the edges of the hardcover assembly using a rounded step formed in the over-wrap guide.
Figure 27:
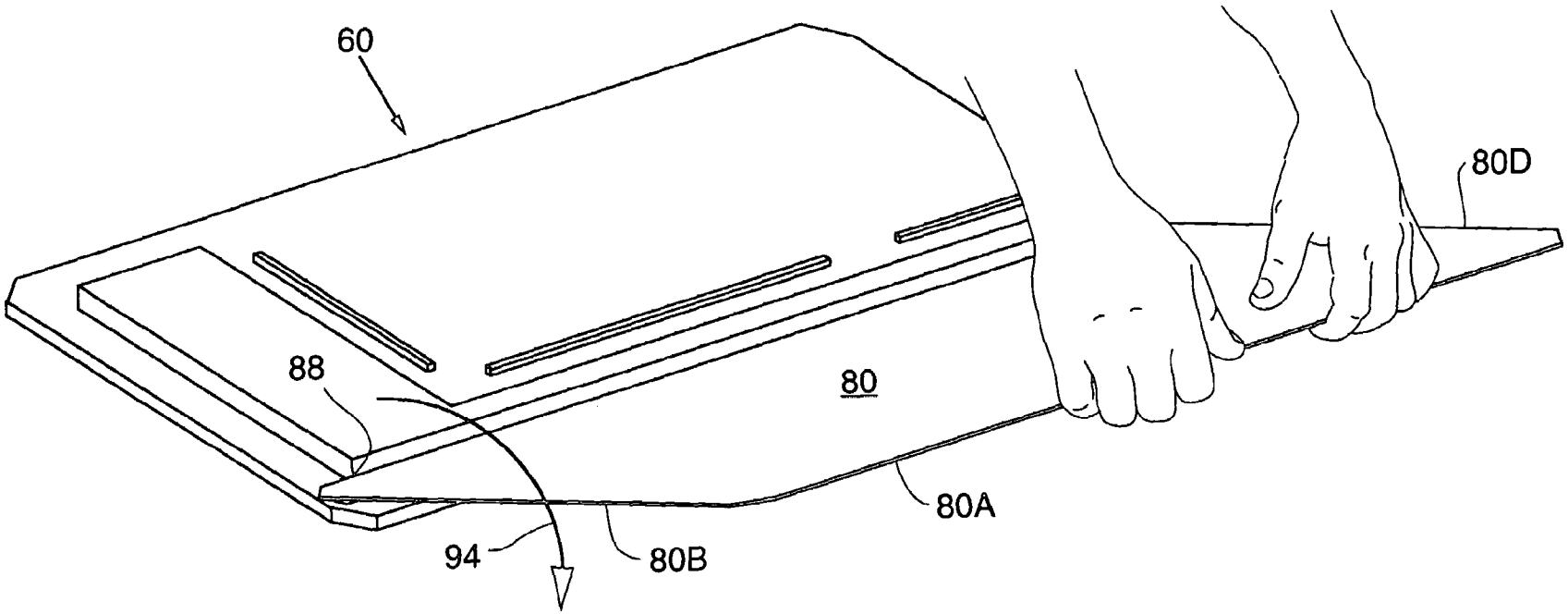
FIG. 27 shows more of the second procedure for wrapping the long edges of the over-wrap sheet around the edges of the hardcover.

The alternative technique for folding the edges 80B and 80D of the over-wrap sheet around the edges of hardcover assembly uses a rounded step 88 formed in the over-wrap guide for that purpose. First, the user holds the combination of over-wrap sheet 80 and hardcover assembly 18 substantially as shown in FIG. 23, except that the lower edge of the combination is positioned on the rounded step 88 of the guide located on the opposite side of the major stop 62 as shown in FIG. 25. The user then rotates the combination in the direction of arrow 94 thereby wrapping the edge of the over-wrap sheet 80 along edge 80C around the edge 90A of the cover assembly 18. The user continues to rotate the combination as shown in FIG. 27 in the direction indicated by arrow 96 until the sheet 80 overhang is wrapped around edge 80C. The user can then finish by pressing the overhang of sheet 80 against the inner surface of the cover assembly 18. The process is repeated for the opposite edge 90C of the cover assembly. Finally, the corners are folded as previously described in connection with FIGS. 26A, 26B, 26C and 26D along with the folding of the overhang along the 80B and 80D at the ends of the over-wrap sheet 80.

In many applications, it is desirable to use cover material not having an adhesive as an over-wrap sheet. In that event, the prior art hardcover assembly 18 (FIG. 3) is replaced with the novel hardcover assembly 106 shown in FIGS. 30-33. As can best be seen in FIG. 30, hardcover assembly 106 includes a pair of relatively rigid cover boards 108A and 108B, preferably fabricated from binders board. For an 8½ inch by 8½ inch book format, cover boards 108A and 108B each measure approximately 8.4 inches in the direction normal to the book spine and 8.7 inches parallel to the spine. The cover boards are typically about 0.09 to 0.10 inches thick. A spine board 110, made of the same material as cover boards, is included, which is approximately 8.7 long. The width of spine board can vary somewhat with the thickness of stack 10 to be bound and is approximately 0.5 inches wide for a model B hardcover assembly as indicated in Table 1, above. For the B size cover assembly, the opposing edges of the cover boards 108A and 108B are spaced approximately 1.4 inches apart.

A sub-cover 130, typically made of Kraft paper, is provided which functions to secure the cover boards 108A and 108B and the spine board 110 in the desired relative relationship. For the B size assembly, the sub-cover 130 is approximately 8.7 inches wide and 18.2 inches long. An adhesive layer 128 is laid on the sub-cover 130, which functions to secure the sub-cover 130 to the cover boards 108A and 108B and the spine board 110. A pressure sensitive adhesive layer 132 is disposed over the entire opposite surface of the sub-cover 130. As will be described, adhesive layer 132 functions to secure the over-wrap sheet to the hardcover assembly 106. A major release liner 134 (see also FIG. 32) is disposed over pressure sensitive adhesive layer 132, with release liner 134 being 8.7 inches wide and about 18.7 inches long, with about ¾ of an inch of the length being folded to form a lifting tab 134A. Release liner 134 covers all of adhesive layer 132, with the exception of a relatively narrow strip 132A located at one end of the adhesive layer which runs along the 8.7 inch width of the layer. The narrow strip 132A is covered by a minor release liner 136 which is also folded to form a lifting tab 136A. The combination of release liners 134 and 136 are sometimes referred to herein as a release liner assembly, with the two release liners 134 and 136 sometimes being referred to herein as release liner sections. As will be seen, with the release liner sections are each separately removable from the release liner assembly.

Figure 30:
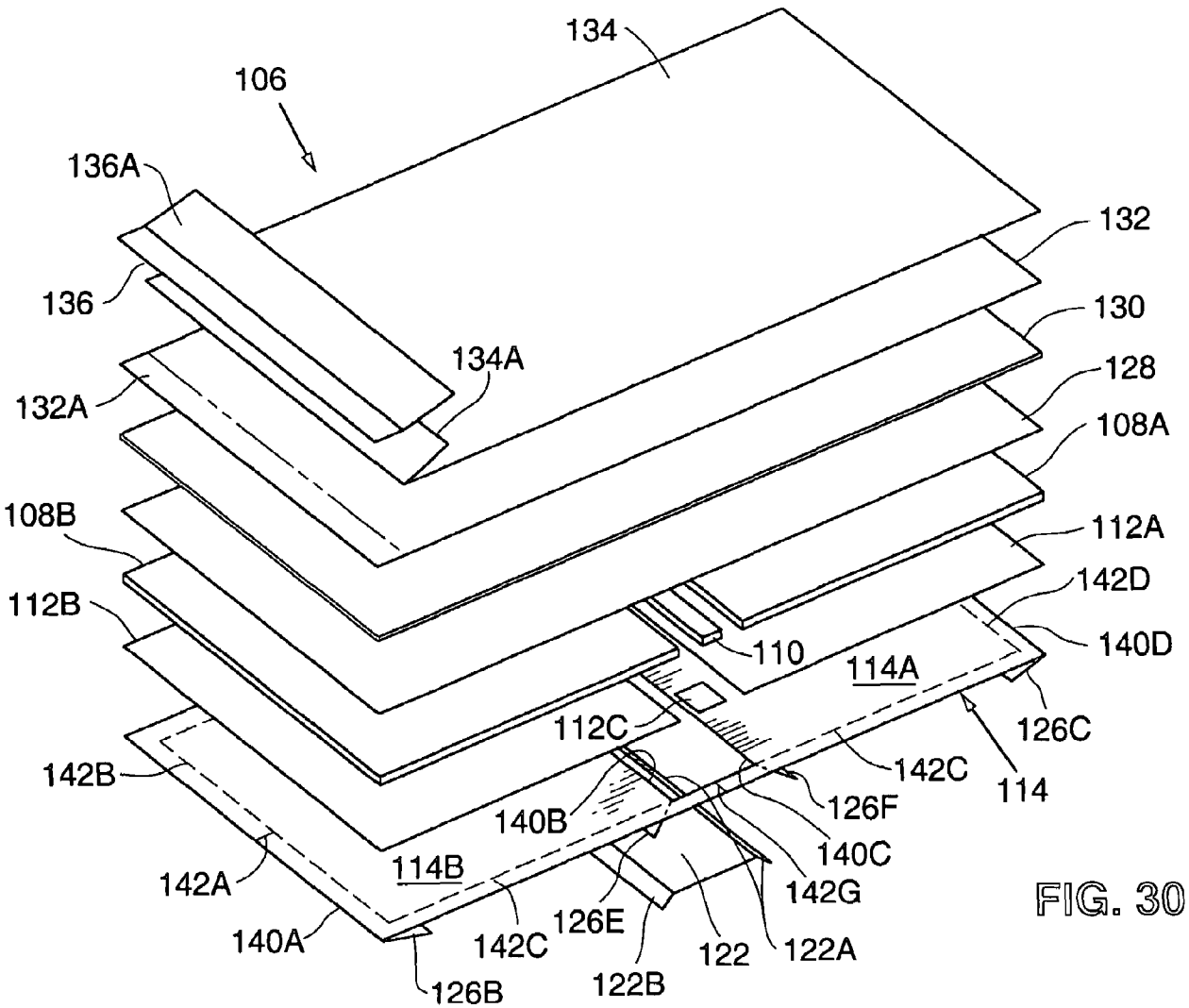
FIG. 30 is an exploded view of a hardcover assembly which permits an over-wrap sheet not having an adhesive layer to be applied to the hardcover assembly.
Figure 31:
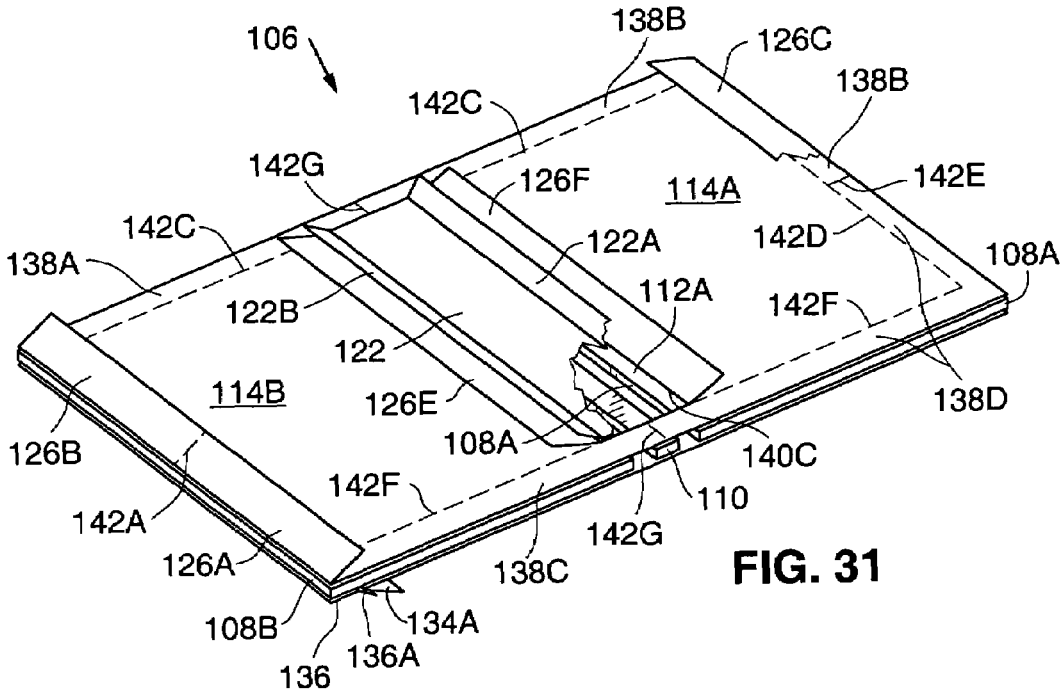
FIG. 31 is a perspective view of the hardcover assembly of FIG. 30, showing the interior side that gets to be applied to the bound stack.
Figure 32:
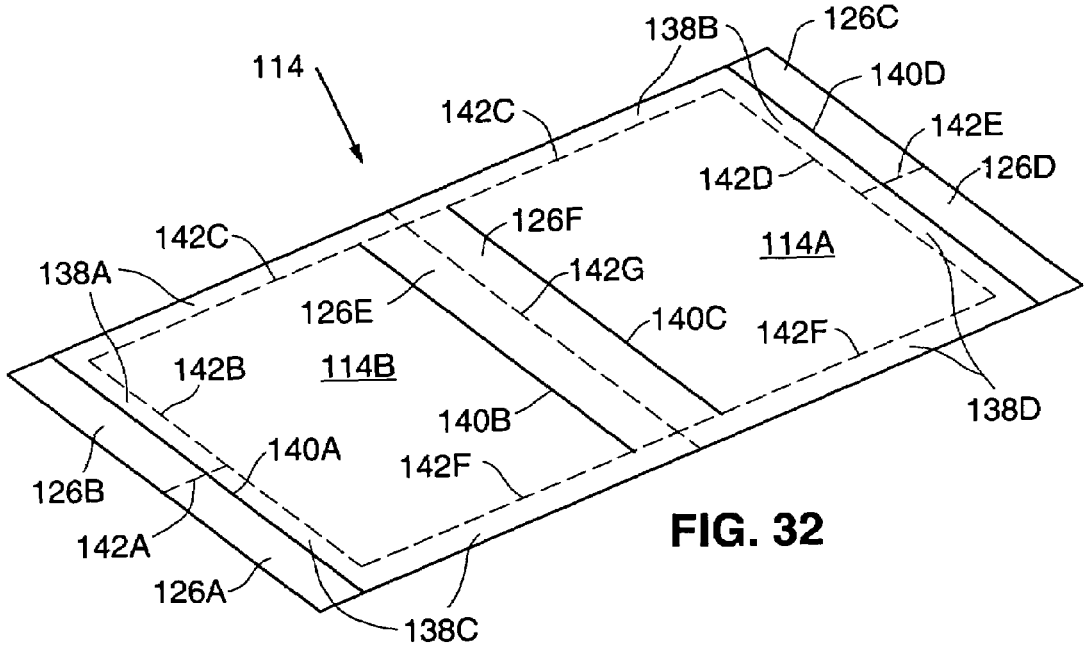
FIG. 32 is a perspective view of a release liner assembly for use in the FIG. 30/31 hardcover assembly, with the release liner assembly being formed from a single sheet of release paper.
Figure 33:
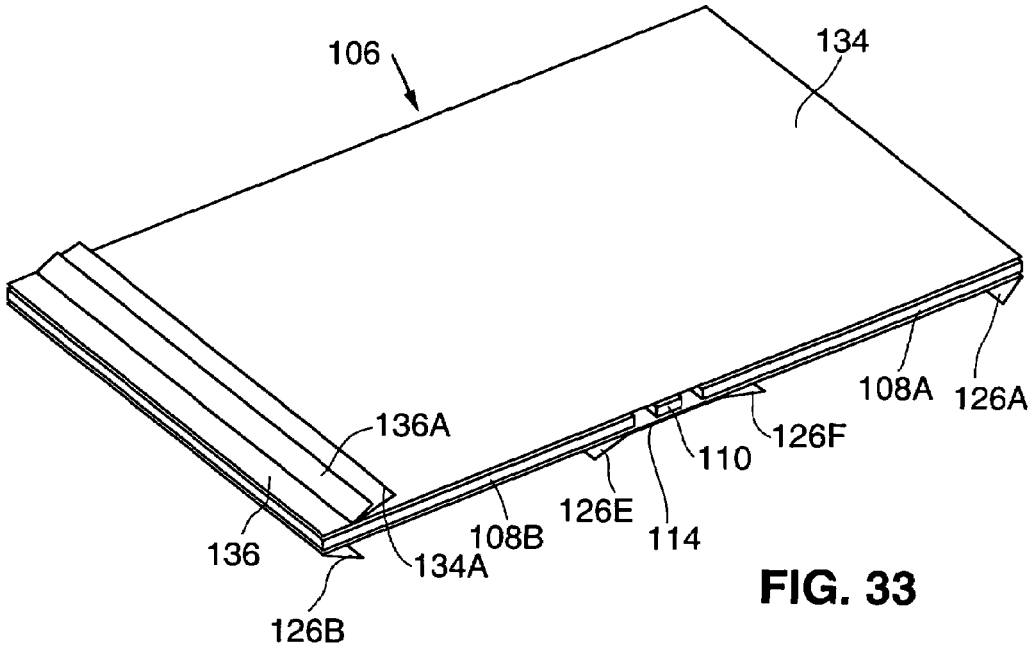
FIG. 33 is a perspective view of the FIG. 30/31 hardcover assembly showing the exterior side of the assembly that receives the over-wrap sheet.

Hardcover assembly 106 further includes release liner assembly 114 disposed below the cover boards 108A and 108B and the spine board 110, as shown in FIGS. 30, 31 and 32. The release liner assembly 114 is approximately 8.7 inches wide and 19.7 inches long. As shown in FIG. 32, the assembly 114 is preferably formed from a single sheet of release paper and is cut and folded in various places to create the final assembly. The solid interior lines of FIG. 32 indicate folds, with the dashed lines of the figure representing cuts in the sheet. Prior to cutting, a first layer 112B of pressure sensitive adhesive is applied to the entire underside of cover board 108B and a second layer 112A of pressure sensitive adhesive is applied to the entire underside of cover board 108A. No adhesive is applied to the underside of spine board 110.

With the cover boards 108A, 108B and spine board 110 held in the proper place by the sub-cover 130, the release liner assembly 114, prior to cutting and folding, is placed over the cover boards. The spacing between the fold lines 140D and 140A is approximately 18.2 inches, with fold line 140D coinciding with one edge of cover board 108A and with fold line 140A being located at the opposite edge of cover board 108B. As previously noted, the release liner assembly 114 is approximately 8.7 inches wide, with the long edges of the assembly being coincident with the respective edges of the cover boards 108A and 108B. With the assembly 114 in place, the release liner is cut along the broken lines shown in FIG. 32 using what is termed in the art as "kiss" cuts where the liner is cut, but not the underlying cover boards 108A, 108B or the spine board 110 which support the liner during cutting.

Supporting members of a thickness similar to the cover boards are positioned in those locations where the cover and spine boards are not present, including the two spaces between the spine board and the cover boards so that liner is supported completely along cut lines 142C and 142F. Supporting members are also located under the liner outside of fold lines 140A and 140D so that the liner is fully supported along cut lines 142A and 142E during the cutting process.

After the cutting is completed, the various cut pieces are held in place by the pressure sensitive adhesive 112A and 112B. A small segment of pressure sensitive adhesive 112C, shown in FIG. 30, functions to hold the small release liner sections adjacent cut 142G near one end of spine board 10 at cut line 142G (FIG. 30) in place. A similar segment of adhesive (not depicted) is provided to secure the release liner adjacent cut 142G at the opposite end of the spine board 10. As shown in FIG. 32, cut lines 142A, 142B, 142C and 142G define a first L-shaped release liner section 138A. Similarly, cut lines 142C, 142D, 142E and 142G defining a second L-shaped release liner section 138B, with cut lines 142A, 142B, 142F and 142G defining a third L-shaped release liner section 138C and with cut lines 142D, 142E, 142F and 142G defining a fourth L-shaped release liner section 138D. Cut lines 142B, 142C, 142G and 142F also form a major release liner segment 114B, with major release liner segment 114A being formed by cuts 142G, 142C, 142D and 142F.

The release liner assembly 114 is folded along line 140A to define release liner lifting tabs 126A and 126B and is folded along line 140D to form release liner lifting tabs 126C and 126D. The cut lines are disposed a distance relative from the fold lines and edges of the liner assembly 114 so that the sections that define each of the four L-shaped release liner sections 138A, 138B, 138C and 138D are about ¼ of an inch wide. Thus, when the four L-shaped release liner sections 138A, 138B, 138C and 138D are removed, a strip of pressure sensitive adhesive 112A/112B, approximately ¼ of an inch wide is exposed around the outer periphery of the cover boards 108A and 108B.

As previously noted, cut lines 142B, 142C, 142G and 142F form a first major release liner section 114B. When the liner is folded up about fold line 140B, a lifting tab 126E for liner section 114B is formed. Similarly, a lifting tab 126F for liner section 114A is created when the liner is folded up about fold line 140C. It is important to note that fold line 140C is located relative to the underlying edge of cover board 108A such that when the release liner section 114A is folded up to form tab 126F, a strip of pressure sensitive adhesive 112A (FIG. 31) remains exposed. A similar strip of pressure sensitive adhesive 112B remains exposed when lift tab 126E is formed after release liner 114B is folded up about fold line 140B. As shown in FIG. 31, the two exposed adhesive strips of respective adhesive layers 112A and 112B are covered by a separate spine release liner 122. Spine release liner 122 is wider than the spacing between fold lines 140B and 140C so that the pressure sensitive adhesive not covered by major release liners 114A and 114B is covered by the spine release liner and thus hold the liner 122 in place. In addition, the liner width permits the outer edges of liner 122 to be folded to form respective lift tabs 122A and 122B as shown in FIG. 31.

Note that it is also possible to make the cut lines for release liner assembly 114 without the assembly 114 being supported by adhesive layers 112A, 112B and 112C. In that event, the cut lines are made incomplete, there being various small bridges of release paper, typically only about 1/32 of an inch long. These small bridges are strategically located to temporarily hold the various release liner sections together until the release liner is positioned on the adhesive layers 112A, 112B and 112C. By way of example, a small bridge can be located on cut line 142G, intermediate cut line 142F and the edge of the sheet, so that the extreme ends of the release liner sections 138D and 138C are temporarily secured together. The small bridges are easily broken when the release liner sections are separately removed by a user.

Having described the construction of the alternative hardcover assembly 106, the manner in which an over-wrap sheet is applied to the assembly will now be described. The over-wrap sheet can be fabricated from a wide range of materials selected by the user, there being no need to apply any type of adhesive to the sheet. The sheet is preferably preprinted with title or other similar information along with decorative art or the like. The sheet is cut to the desired size using the previously described over-wrap guide 60 as a template, using the reticule 72 and related grid lines to assist in positioning the guide as shown in FIGS. 14 and 29. The cut over-wrap sheet 144 is then set aside.

Figure 34:
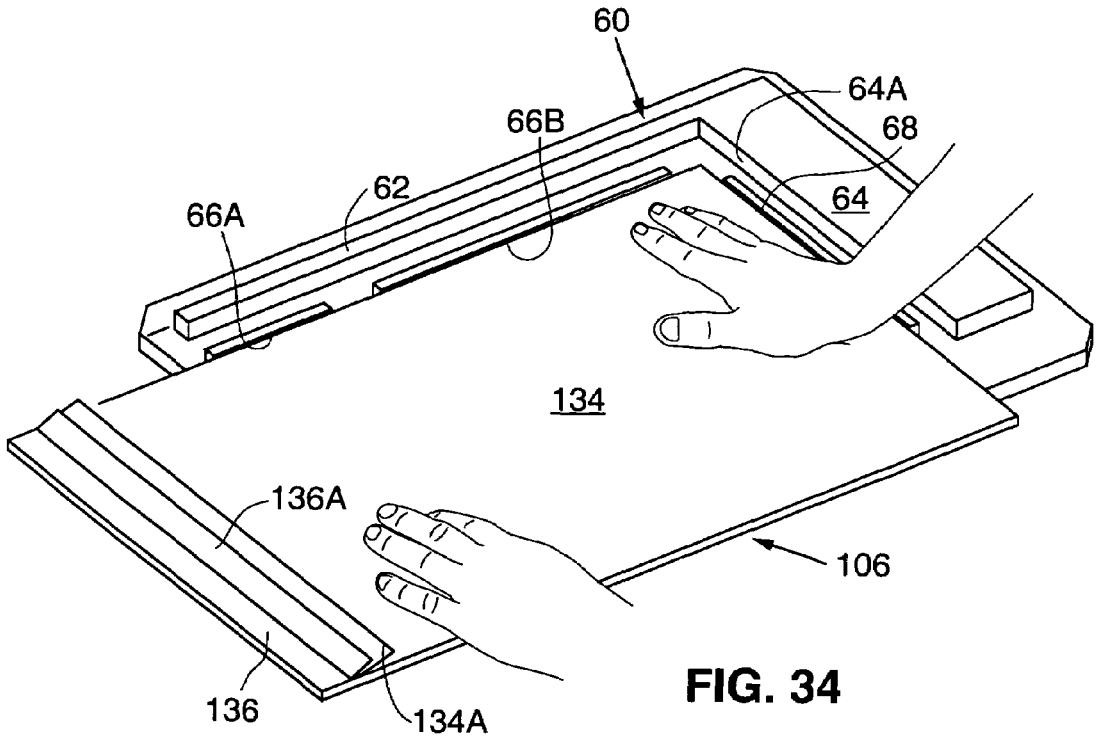
FIG. 34 shows the hardcover assembly of FIG. 30/31 being positioned on the over-wrap guide in preparation for applying the over-wrap sheet.
Figure 35:
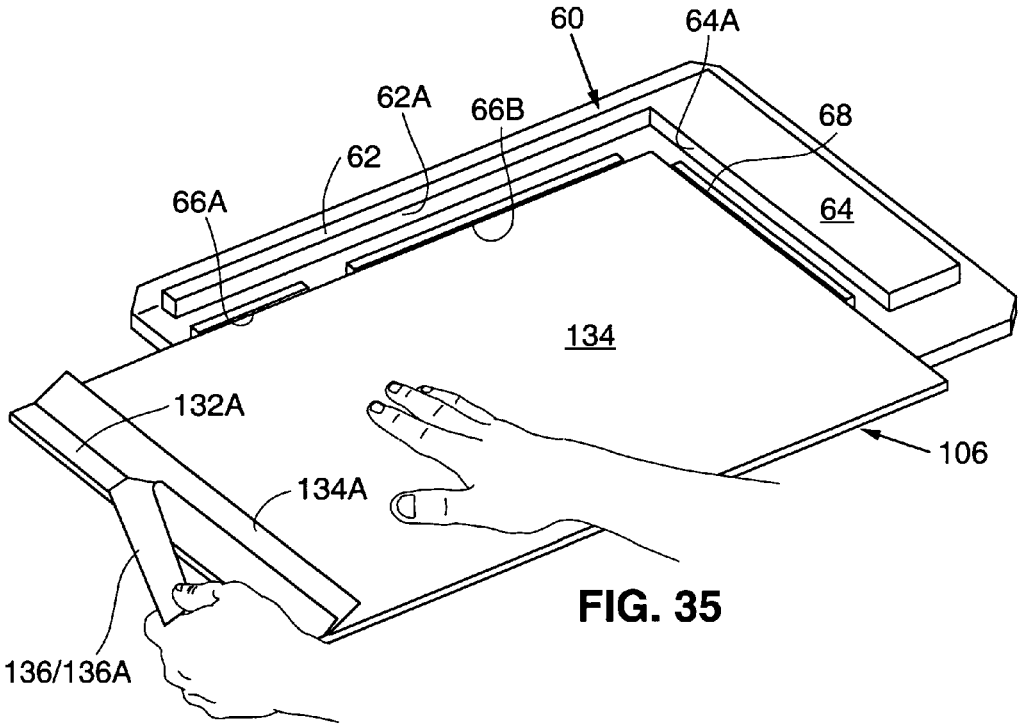
FIG. 35 shows removal of a release liner in preparation for applying the over-wrap sheet.

The user then positions the hardcover assembly 106 on the over-wrap guide 60 as shown in FIG. 34, with major release liner section 134 facing up. The assembly is positioned so that the minor release liner section 136 is at the user's left, with the right and top edges of the assembly abutting respective minor stop 68 and minor stops 66A and 66B of the over-wrap guide 60. The user then lifts minor release liner 136 away from the assembly, using lift tab 136A, so as to expose a relatively narrow strip 132A of pressure sensitive adhesive of adhesive layer 132, as shown in FIG. 35.

Figure 36:
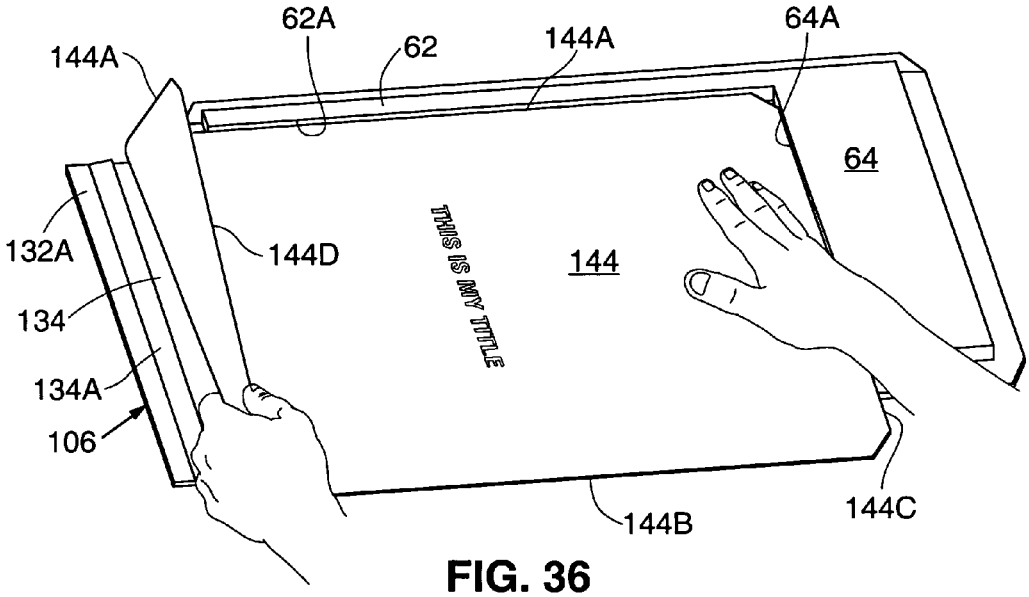
FIGS. 36 and 37 show the over-wrap sheet being applied to the hardcover assembly.

With the hardcover assembly 106 in place, the cut over-wrap sheet 144 is placed over the assembly as shown in FIG. 36, with sheet edge 144C of the sheet abutting major stop 64 of the guide 60 and sheet edge 144A abutting major stop 62. At this point, the over-wrap sheet 144 will be correctly positioned on the hardcover assembly 106, with the periphery of the sheet extending past the edges of the assembly the proper and equal distances so that the sheet can be wrapped around the assembly, as will be described. The user holds the sheet 144 in place with the right hand near sheet edge 144C and lowers the left portion of the sheet near edge 144D on to the exposed adhesive 132A. The adhesive strip 132A locks the sheet 144 into the correct position relative to the hardcover assembly 106.

Figure 37:
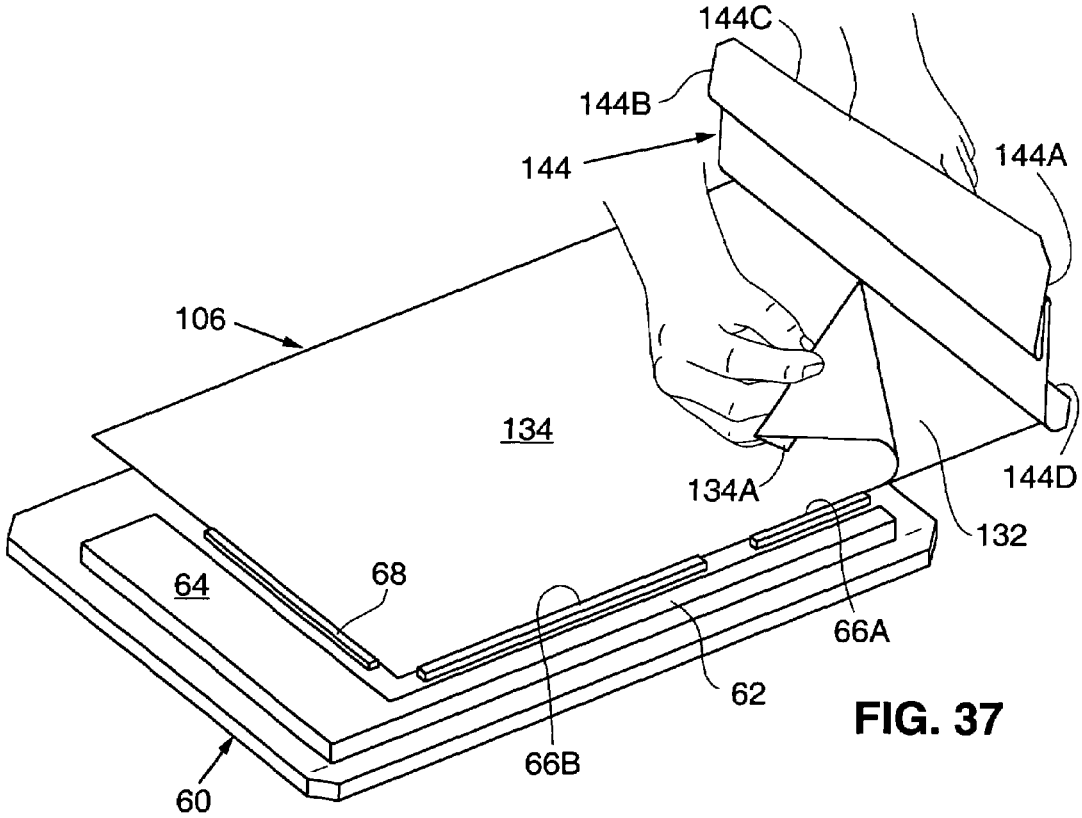

The user then lifts the free edge 144C of sheet away from the cover assembly 106 as shown in FIG. 37, without disturbing the bond between the assembly and the sheet near edge 144D created by adhesive strip 132A. The sheet is lifted an amount sufficient to permit access to the lift tab 134A of the major release liner section 134. The release liner section 134 is lifted away from the assembly 106, taking care not to permit the free portion of the sheet 144 from contacting the newly exposed adhesive 132. Once the liner 134 has been removed, the user proceeds to force the sheet against the exposed adhesive 132 starting near edge 144D and working slowly across the sheet towards edge 144C, taking care to avoid forming air pockets between the sheet 144 and the adhesive 132. The over-wrap sheet 144 is pressed across the entire surface of the assembly 106 to ensure that the sheet is properly attached.

Figure 38:
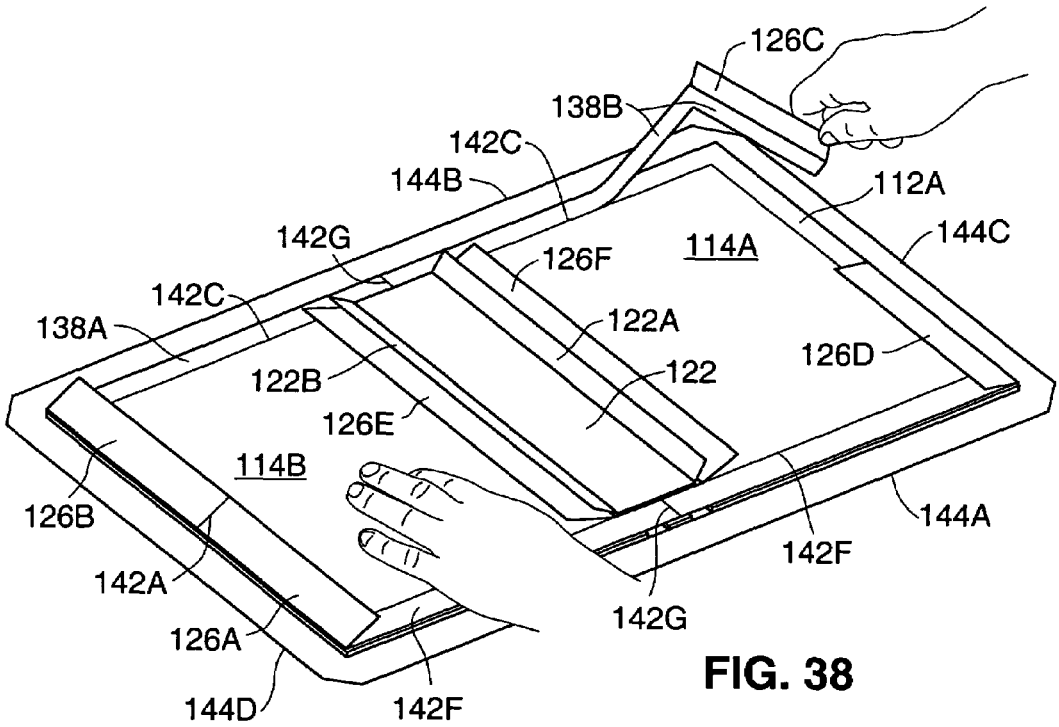
FIGS. 38/39 show the removal of various release liner sections in preparation for placement of the bound stack on the hardcover assembly.
Figure 39:
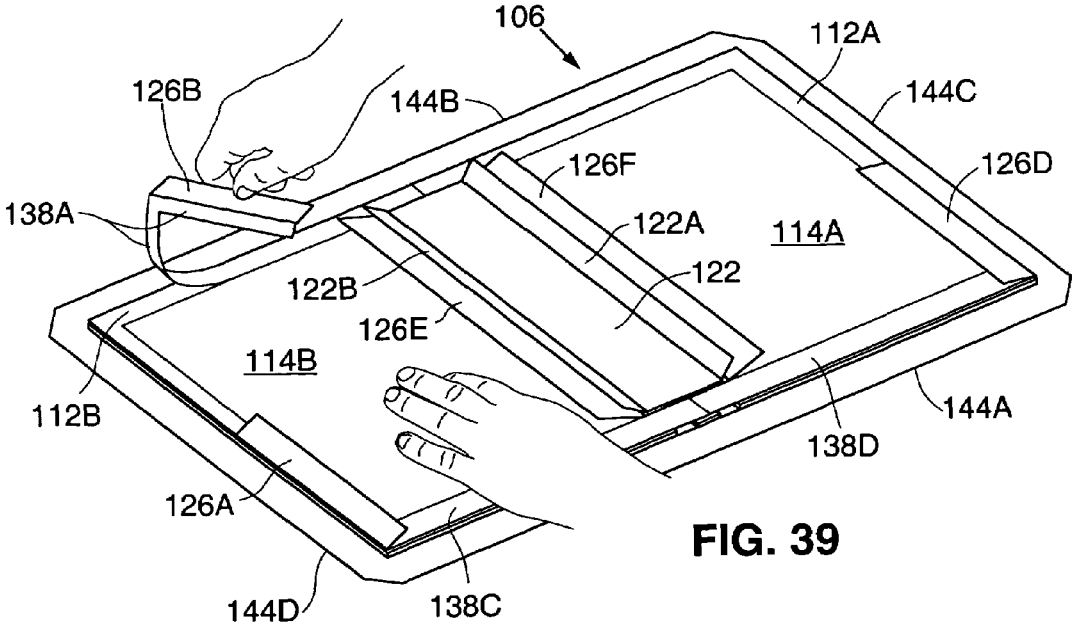

At this point, the four edges of sheet 144 extend past the respective edges of the hardcover assembly 106 a distance nominally equal to the distances between line 98A (FIG. 29) and edge 60A of guide 60, between line 98B and guide edge 60B, between line 98C and guide edge 60C and between line 98D and guide edge 60D. As shown in FIG. 38, the user removes the assembly from guide 60 and places the assembly on a flat surface with the over-wrap sheet 144 down. The user then lifts tab 126C away from the hardcover assembly 144 causing L-shaped release liner section 138B to be separated from the assembly. This results in an L-shaped strip of pressure sensitive adhesive 112A to be exposed. Next, as shown in FIG. 39, the user lifts tab 126B away from the hardcover assembly 144 causing L-shaped release liner section 138A to be separated from the assembly. This results in an L-shaped strip of pressure sensitive adhesive 112B to be exposed.

Figure 40:
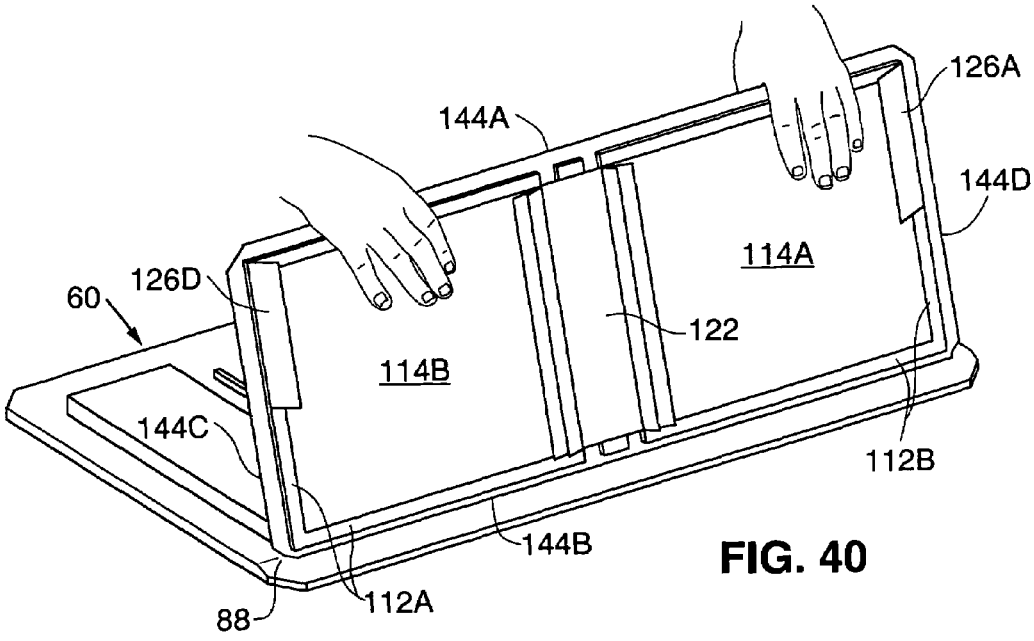
FIG. 40 shows part of the sequence for folding the edges of the over-wrap sheet around the edges of the hardcover assembly.

The removal of release liners 138A and 138B results in an exposed strip of adhesive adjacent the entire length of over-wrap sheet 144 along edge 144B and adjacent about half of the lengths of the sheet along edges 144C and 144D as shown in FIG. 39. At this point, the user folds edge 144B of the sheet around the adjacent edge of the hardcover assembly by gripping the assembly as shown in FIG. 40, with the edge of the assembly forced down against a surface such as curved surface 88 of over-wrap guide 60. The user continues to rotate the assembly in the same manner shown and described in connection with FIG. 27 thereby folding the exposed edge 144A of the sheet around the assembly, with the edge being secured in place by the exposed sections of adhesives 112B and 112A.

The process is repeated for opposite over-wrap sheet edge 144A by first removing L-shaped release liner sections 138C and 138D thereby exposing L-shaped adhesive strips of adhesive 112A and 112B. The user then folds the edge 144A of the sheet around the edge of the assembly 106 in the same manner as previously described in connection with edge 144B. At this point, a strip of adhesive 112A and 112B is exposed along the entire edge of the assembly adjacent edges 144C and 144D of the over-wrap sheet. Thus, the remaining edges 144C and 144D are wrapped around the respective edges of the assembly, with the four corners being formed in the same manner as previously described in connection with FIGS. 26A-26D.

Once the over-wrap sheet 144 has been secured to the hardcover assembly 106, the assembly and the bound stack 10 are combined in a manner similar to that depicted in the prior art FIGS. 8A-8M. Note that the assembly 144, like the prior art cover assembly, has front and back cover components coupled together by a flexible spine member. Thus, it is necessary to first align and secure the stack 10 with respect to one cover component and to then align and secure the stack with respect to the other cover component.

Figure 6:
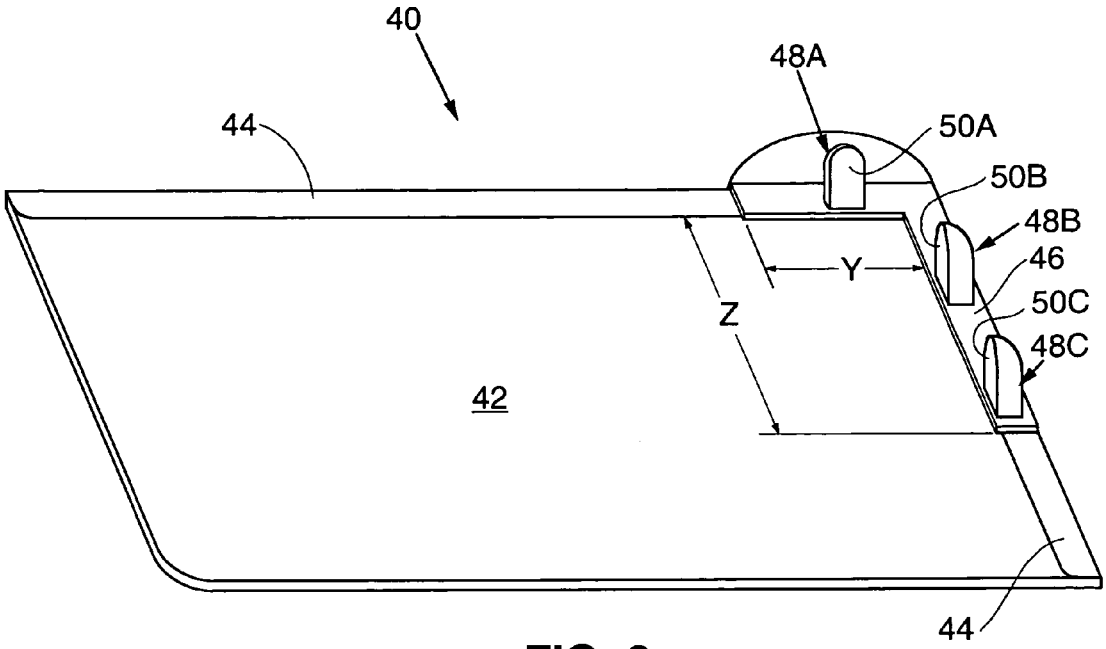
FIG. 6 (PRIOR ART)
FIG. 6 is a perspective view of a prior art the guide apparatus used to attach the hardcover assembly to the bound stack.
Figure 7:
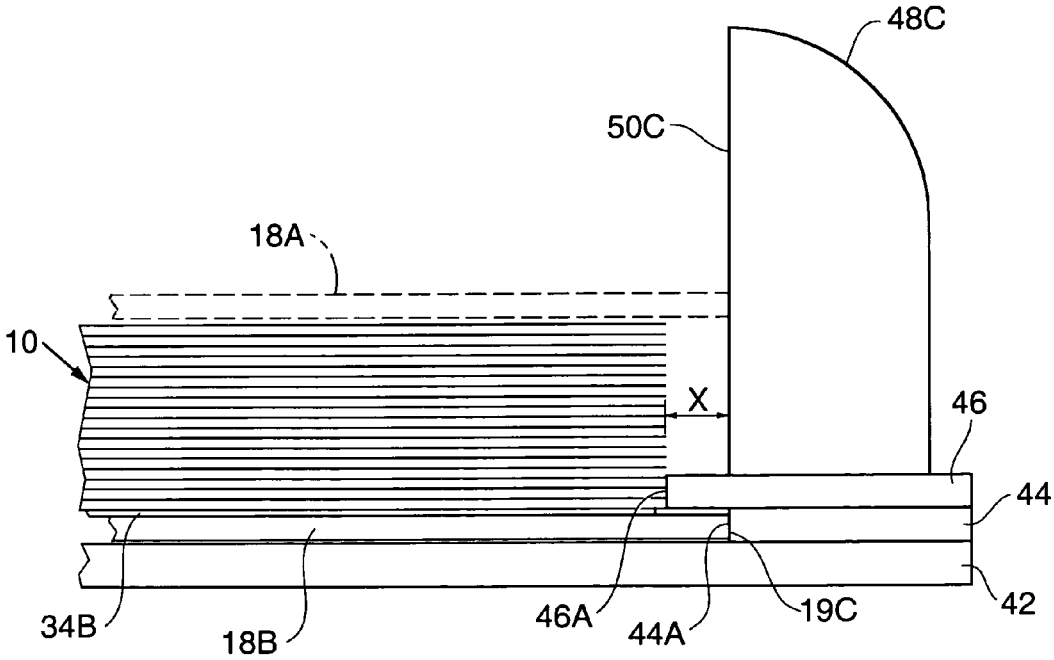
FIG. 7 (PRIOR ART)
FIG. 7 is an expanded side view of a portion of the guide apparatus of FIG. 6 with a stack to be bound shown in position.
Figure 41:
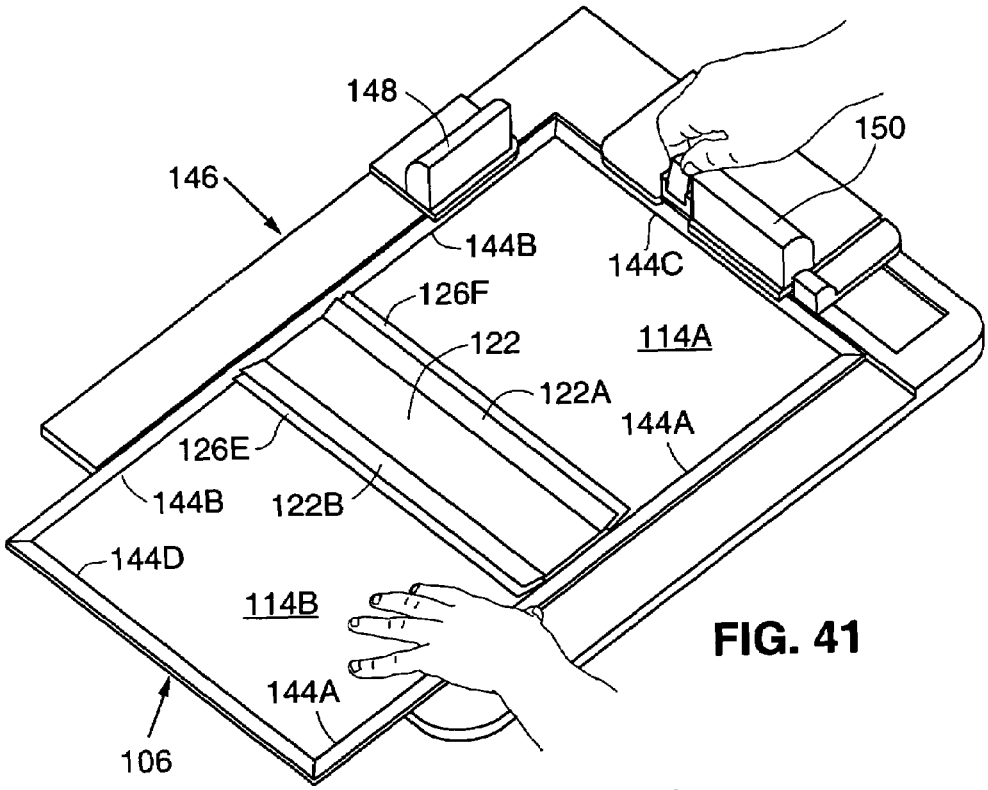
FIGS. 41 and 42 show the wrapped hardcover assembly positioned on a hardcover guide so that a bound stack can be secured to the assembly.

The covered hardcover assembly 106 is first positioned in a hardcover guide 146 shown in FIG. 41 which is functionally identical for the purposes of the present invention to the prior art hardcover guide of FIGS. 6 and 7. Further improvements in the hardcover guide which provide improved support so as to maintain the edge of the stack 10 (FIG. 7) in a vertical position are disclosed in application Ser. No. 10/385,960 which was filed on Mar. 10, 2003, the contents of which are fully incorporated herein by reference. A clamping mechanism can also be provided to secure the hardcover assembly 106 on the hardcover guide 146. The covered hardcover assembly 106 is positioned on the receiving surface of the hardcover guide 146, with the edges of the assembly abutting the appropriate guide elements of the guide as previously shown and described in connection with FIG. 8A.

Figure 42:
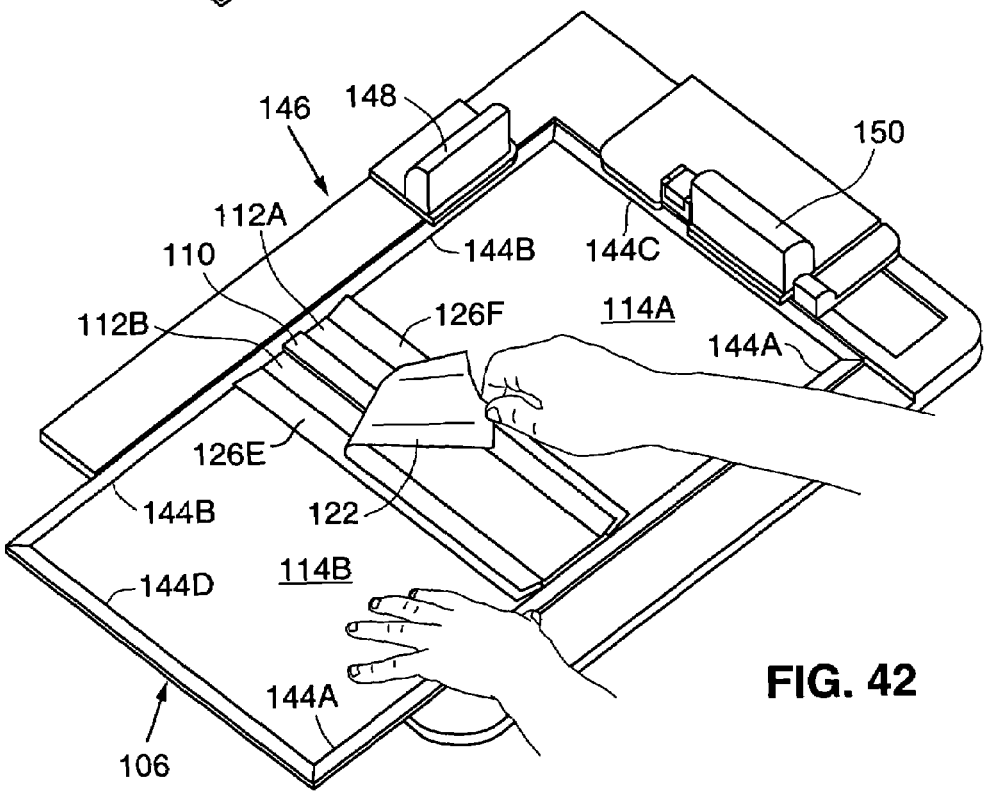

As shown in FIG. 42, release liner 122 is then removed thereby exposing two strips of pressure sensitive adhesive of respective adhesive layers 112A and 112B, with the adhesive layers being disposed on the upper surfaces of respective cover boards 108A and 108B. The exposed adhesive strips provide essentially the same function as adhesive strip 34B of FIG. 8B and adhesive strip 34A of FIG. 8H.

Figure 8A:
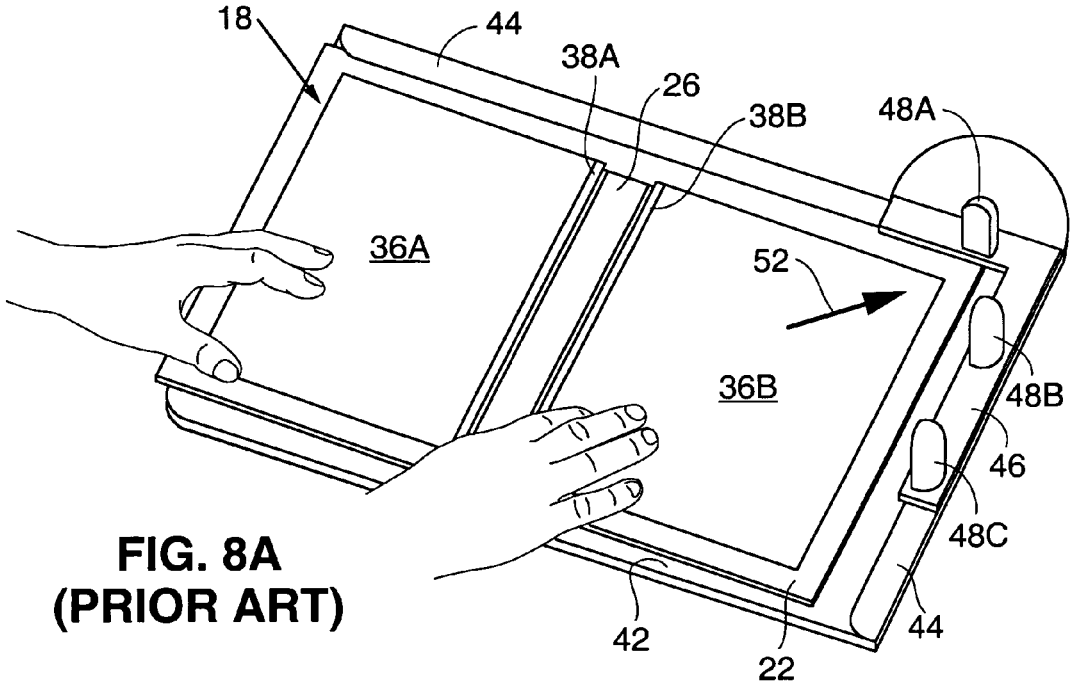
FIG. 8A (PRIOR ART)
FIGS. 8A-8M depict a prior art process for assembling the bound book.
Figure 8B:
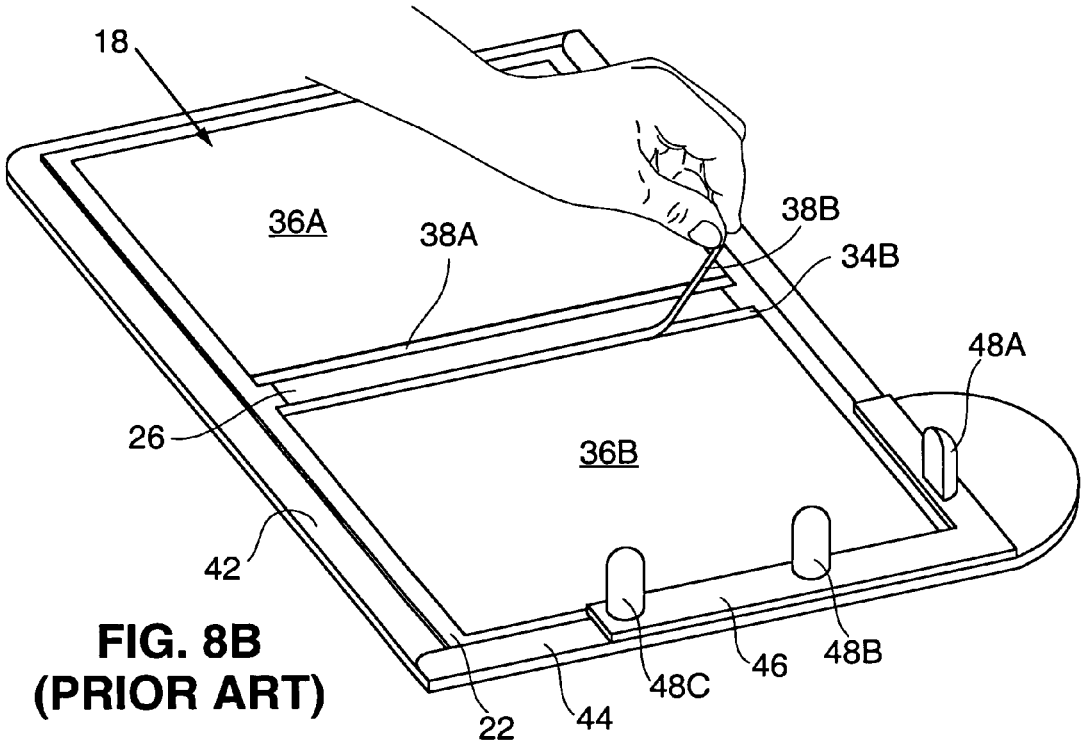
FIG. 8B (PRIOR ART)
Figure 8C:
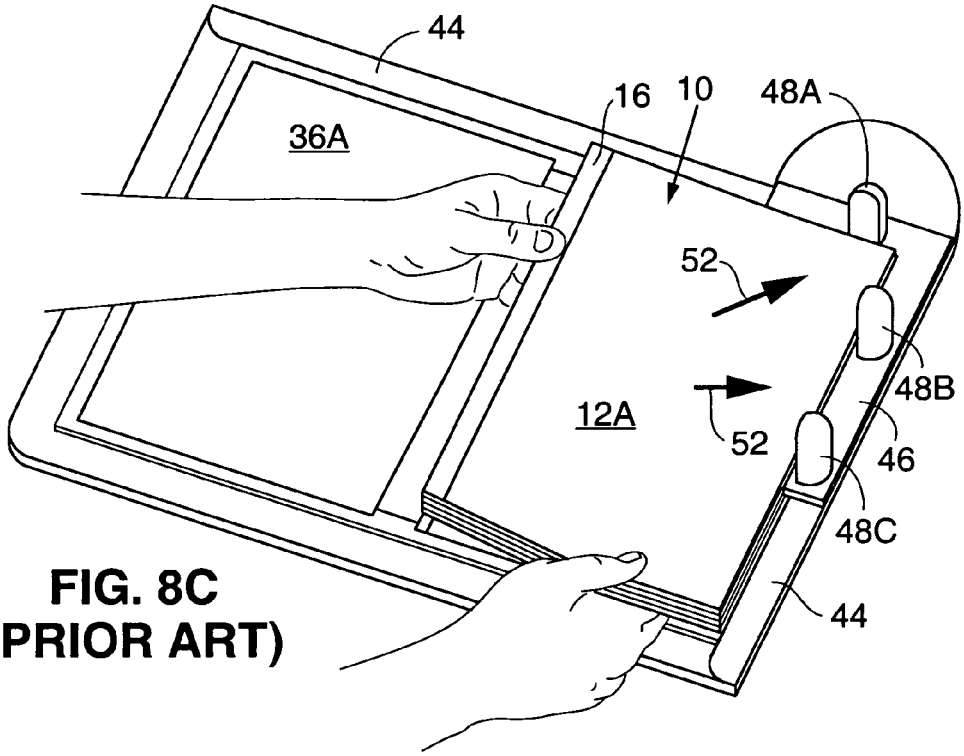
FIG. 8C (PRIOR ART)
Figure 8D:
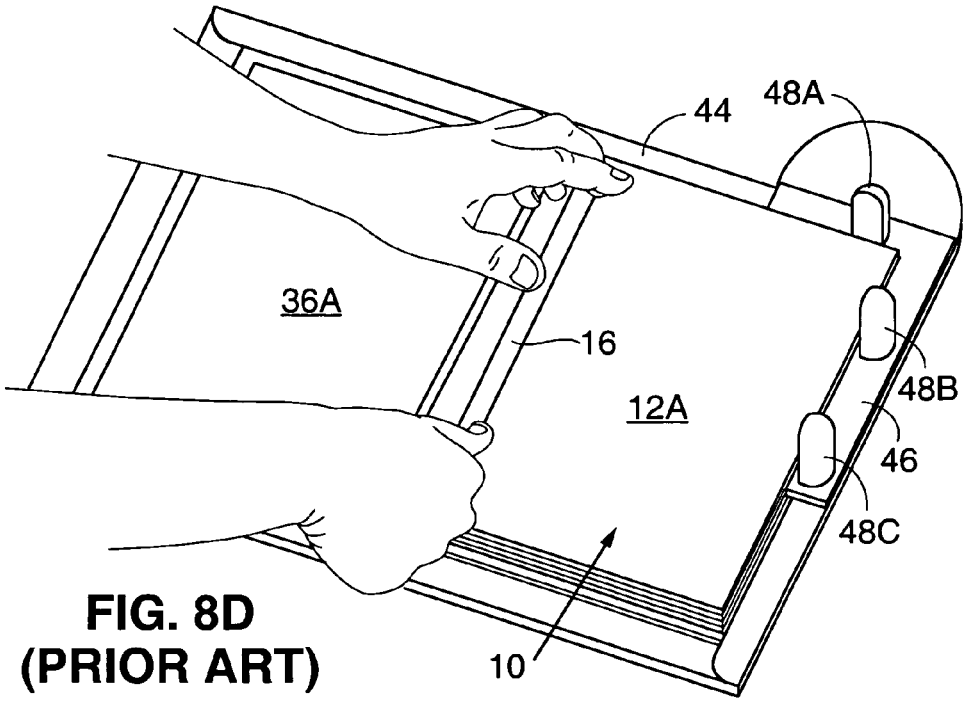
FIG. 8D (PRIOR ART)
Figure 8E:
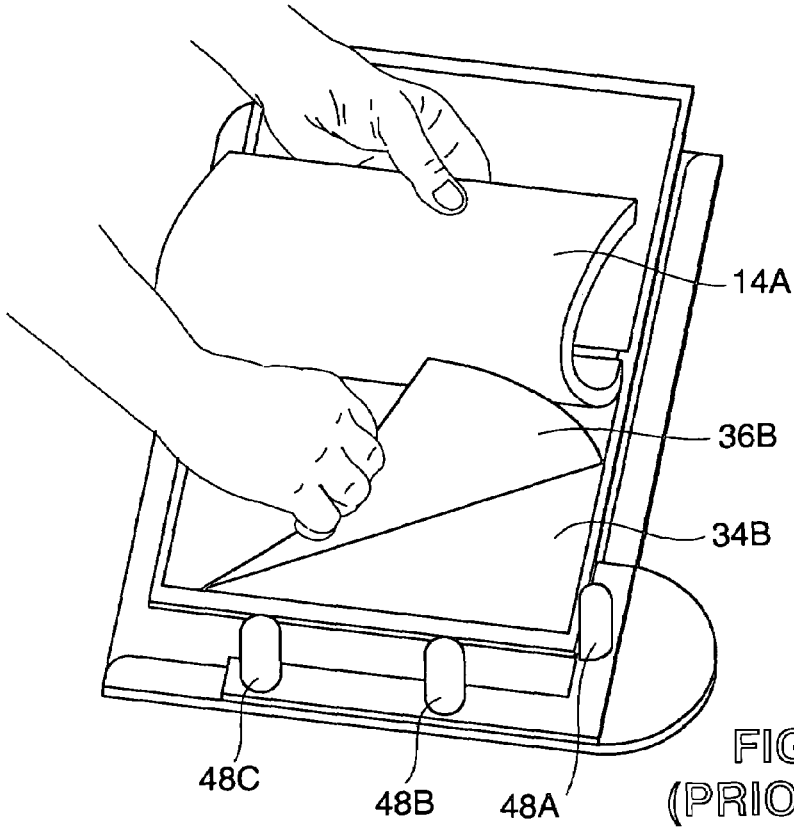
FIG. 8E (PRIOR ART)
Figure 8F:
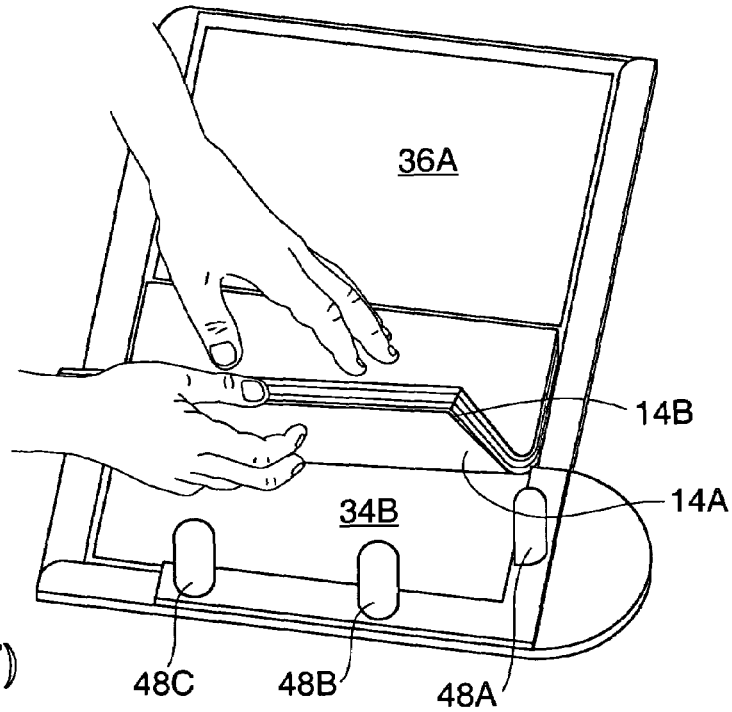
FIG. 8F (PRIOR ART)
Figure 8G:
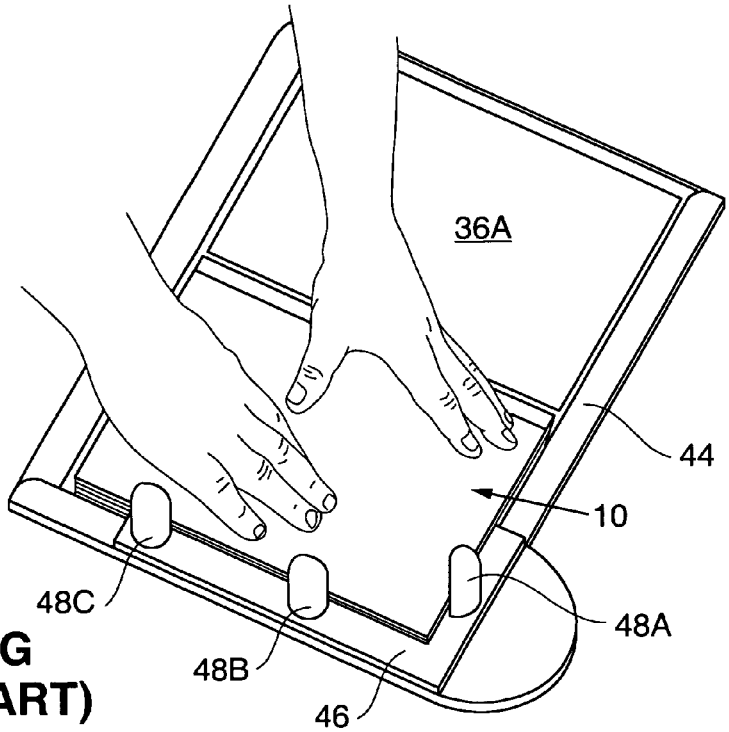
FIG. 8G (PRIOR ART)

The bound stack 10 to be covered is then placed over major release liner section 114A, with the edges of the stack abutting stops 148 and 150, much in the same manner as shown in FIG. 8C. This correctly aligns the stack 10 with the first cover component which includes cover board 108A. When the stack 10 is so positioned, the stack is secured to the first cover component by the narrow strip of pressure sensitive adhesive 112A which was exposed by removal of liner 122. This locks the stack and first cover component in the correct position relative to one another. The user then lifts the free edge of the stack 10 up away form major release liner 114A in much the same manner as previously depicted and described in connection with FIG. 8E. This provides access to lift tab 126F which is gripped by the user so that major release liner section 114A can be removed thereby exposing the remainder of the pressure sensitive adhesive 112A. The user then returns the free edge of stack 10 to the original position, similar to what is shown in FIG. 8G, with adhesive 112A securing the lower sheet of the stack to the cover board 108A. Thus, the stack 10 is fully secured with respect to the first cover component.

Figure 8H:
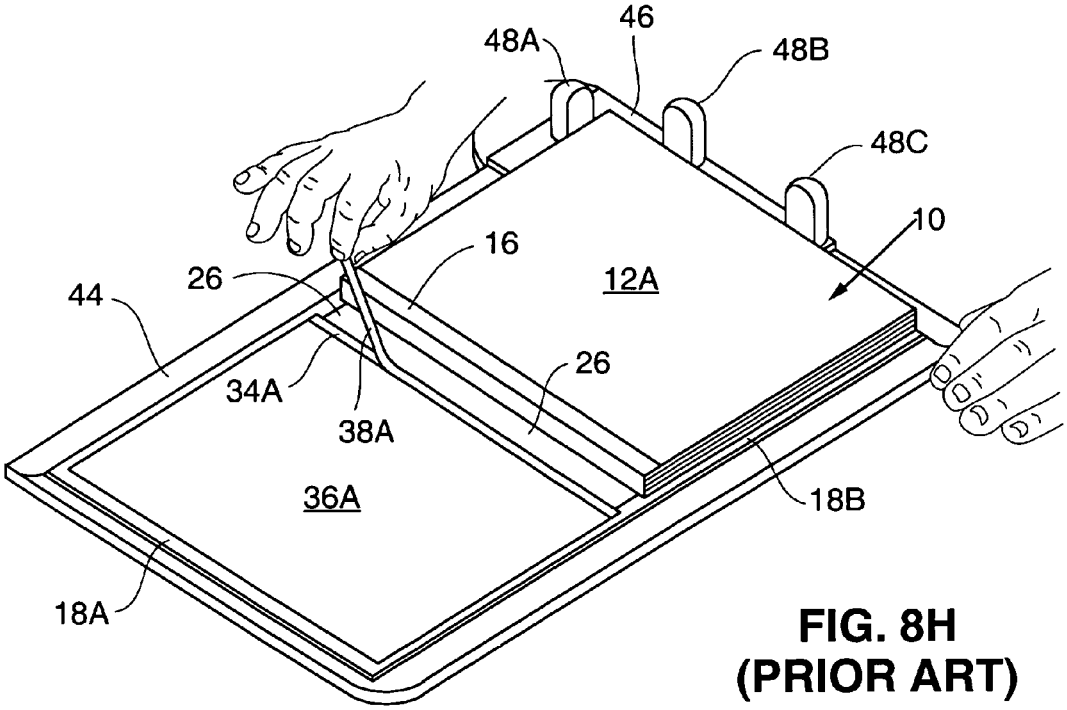
FIG. 8H (PRIOR ART)
Figure 8I:
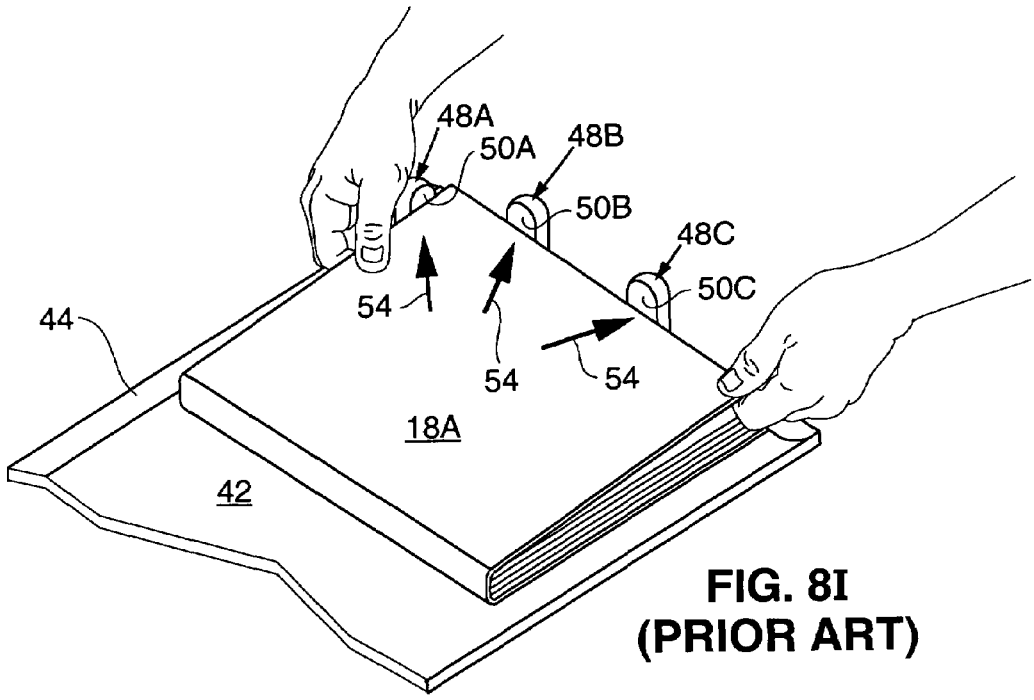
FIG. 8I (PRIOR ART)
Figure 8J:
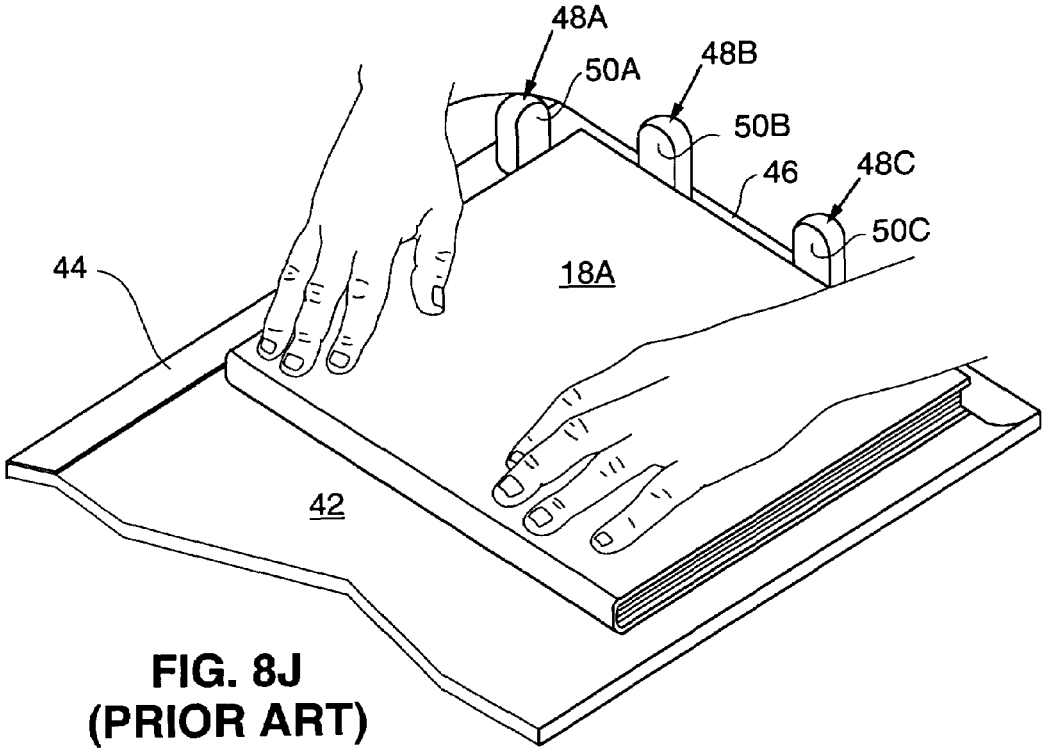
FIG. 8J (PRIOR ART)
Figure 8K:
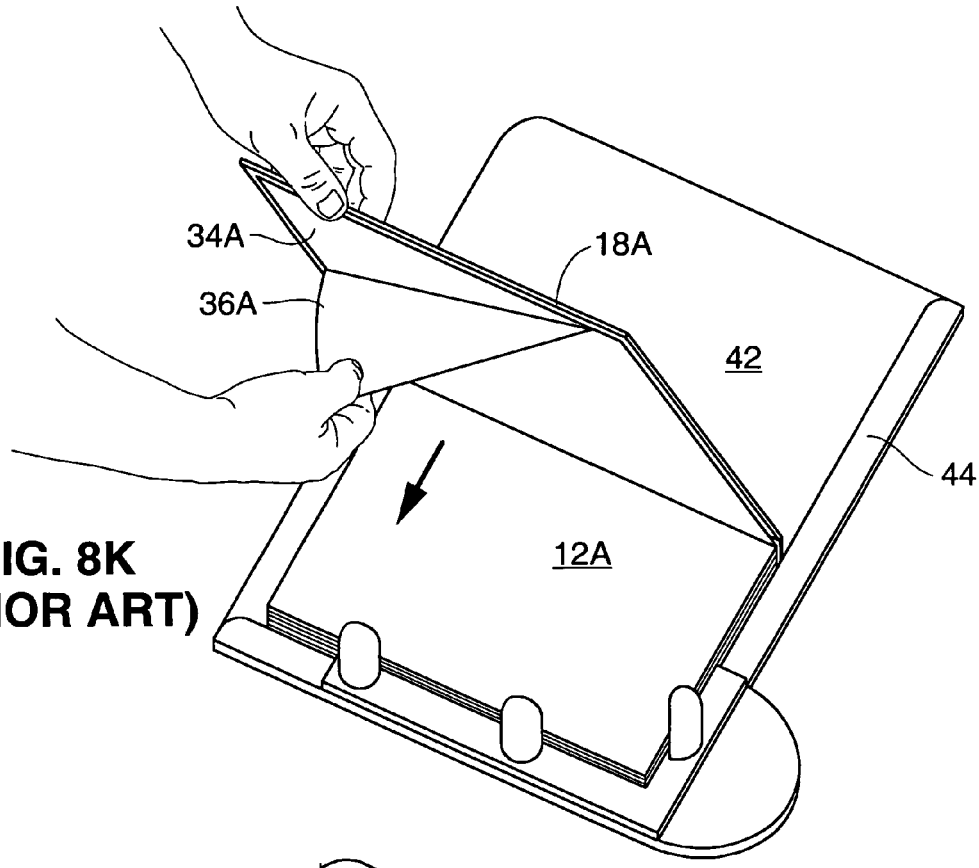
FIG. 8K (PRIOR ART)
Figure 8L:
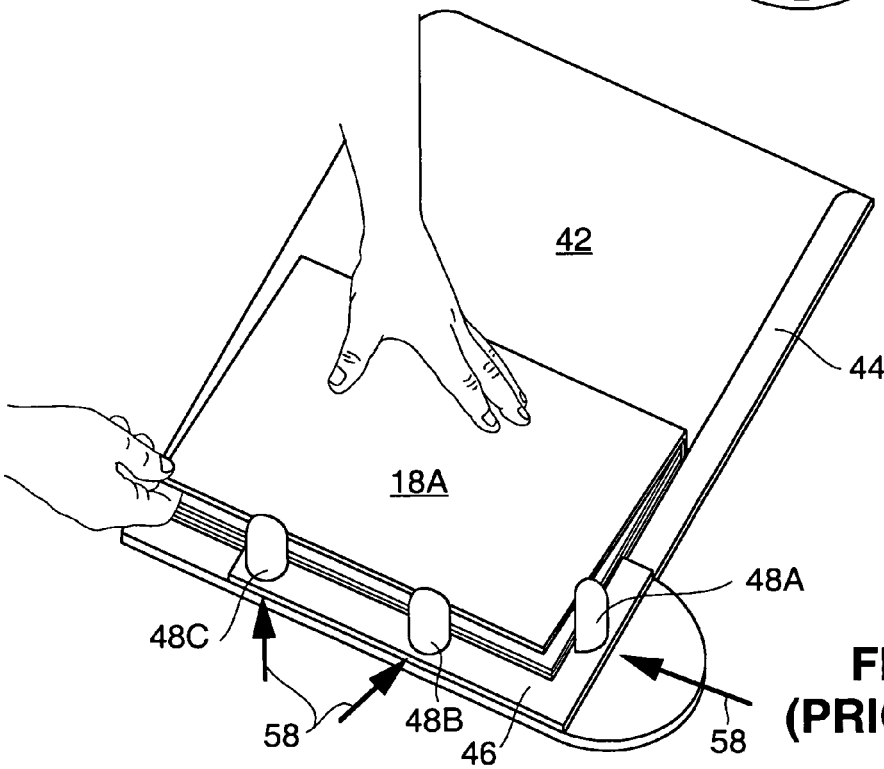
FIG. 8L (PRIOR ART)
Figure 8M:
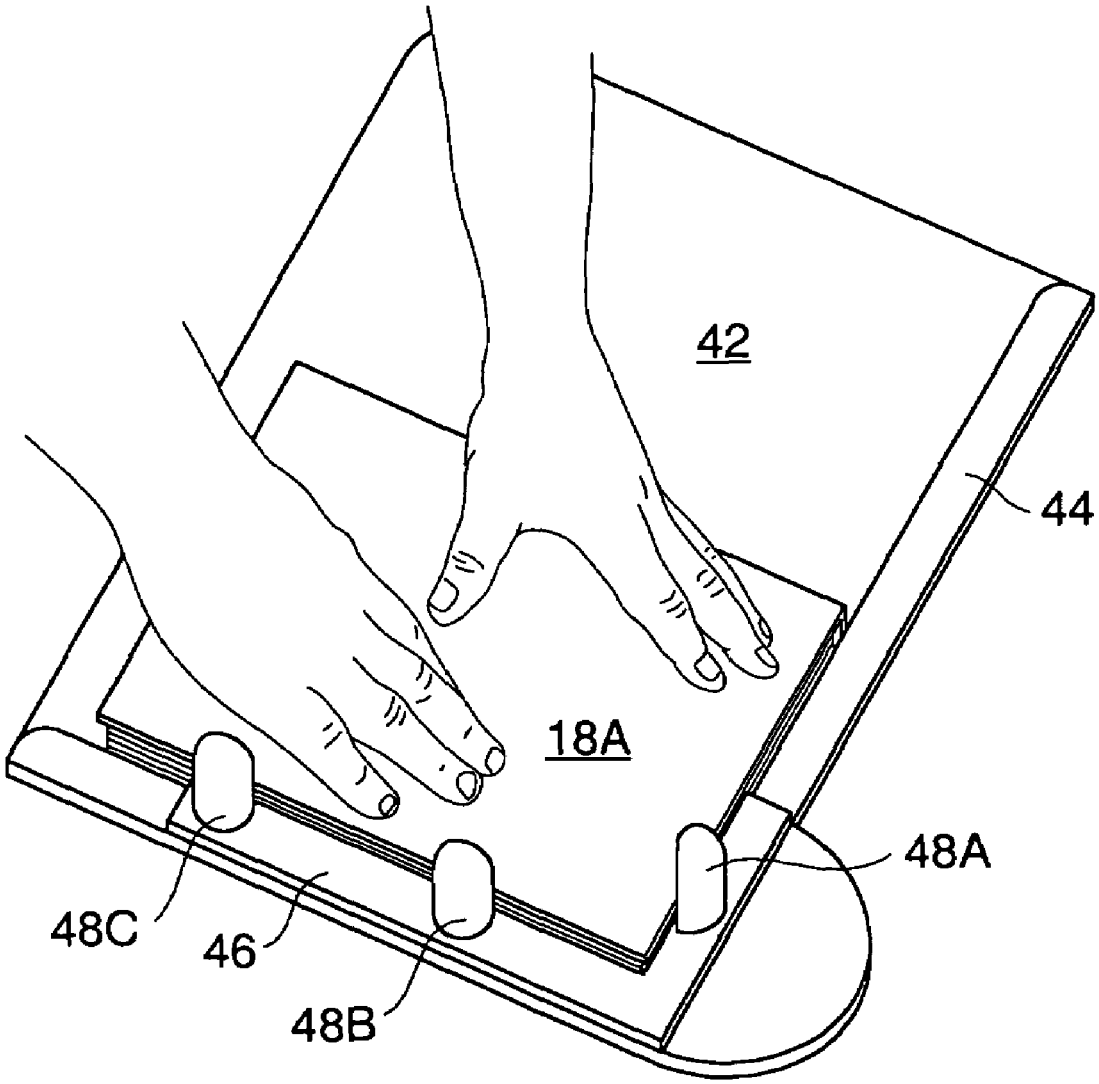
FIG. 8M (PRIOR ART)
Figure 9A:
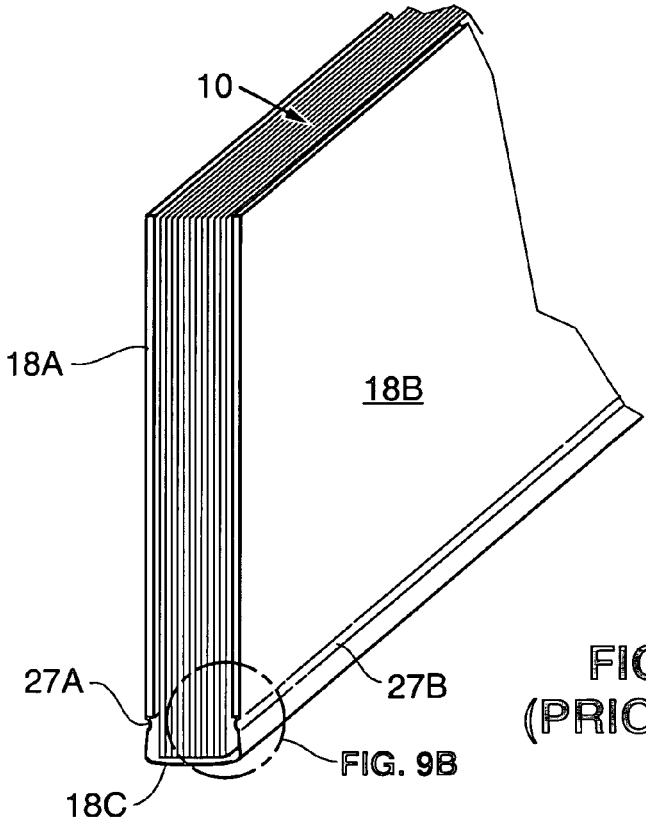
FIG. 9A (PRIOR ART)
FIGS. 9A and 9B are perspective views of portions of the completed prior art book.
Figure 9B:
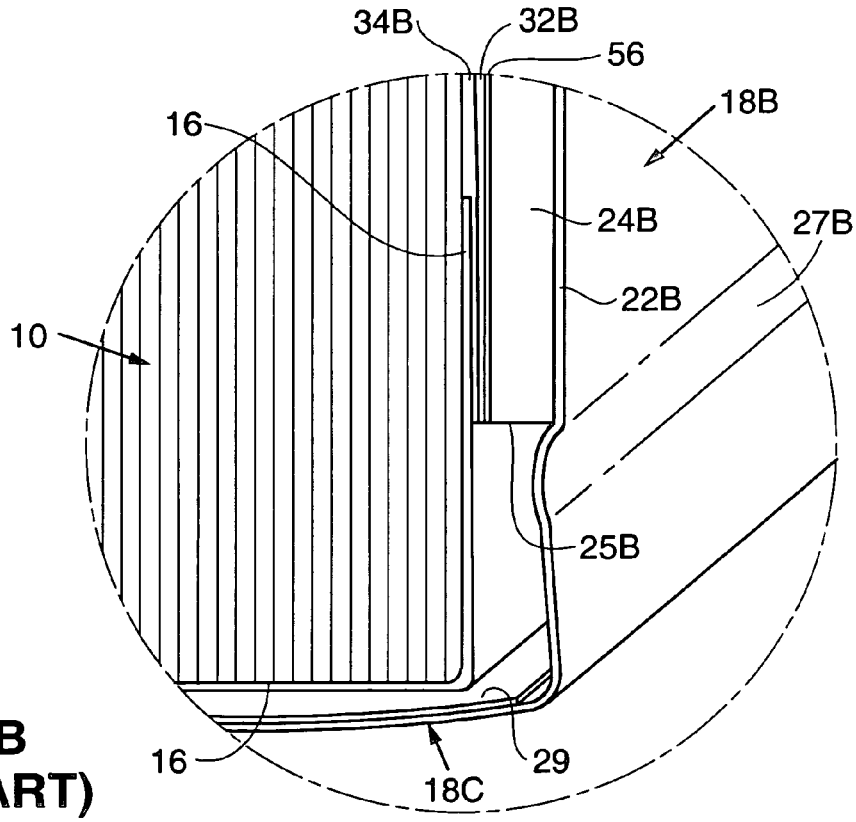
FIG. 9B (PRIOR ART)
Figure 10:
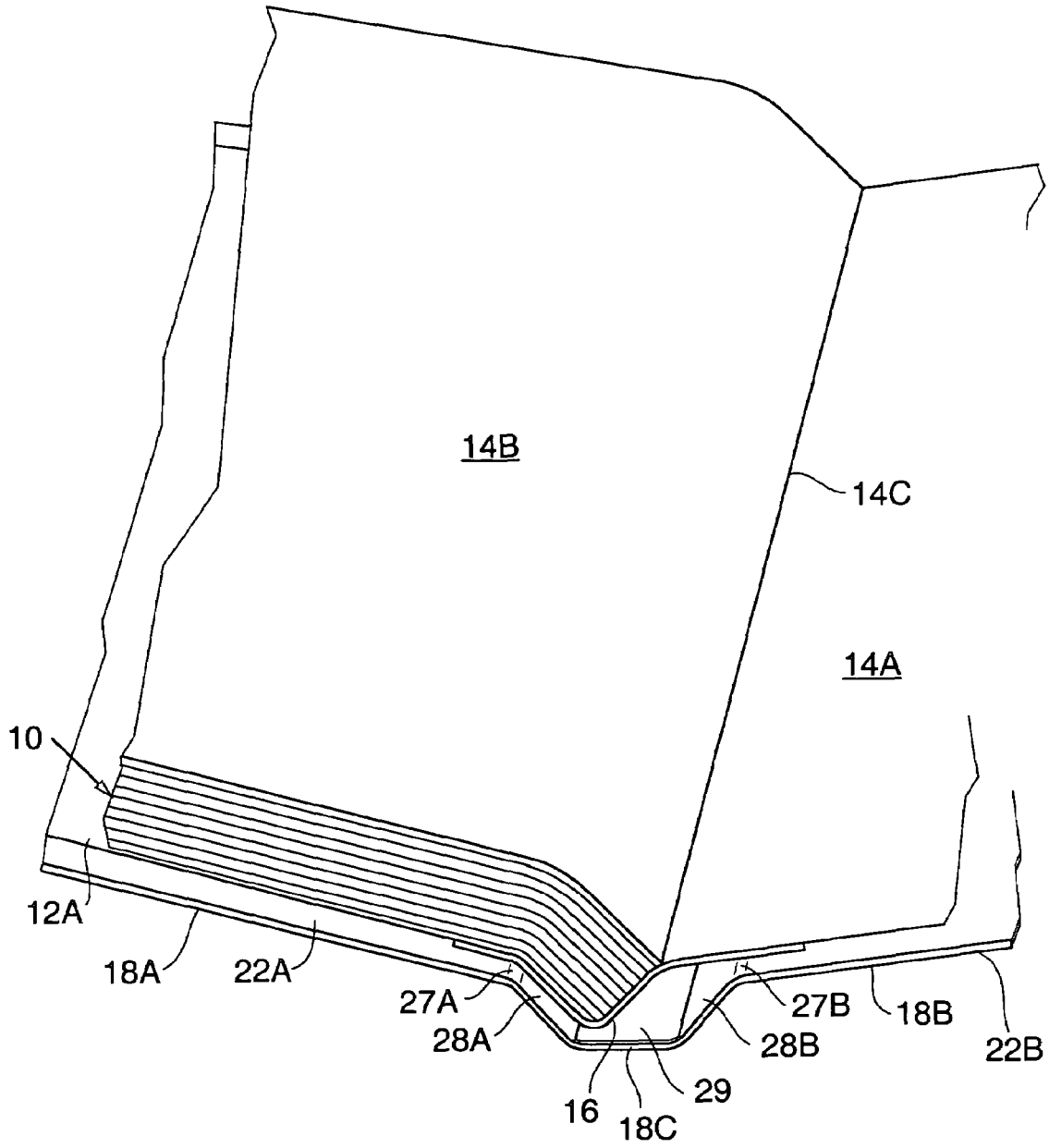
FIG. 10 (PRIOR ART)
FIG. 10 is a perspective broken view of the completed prior art book shown in an open position.

In prior art FIG. 8H, the step of exposing the second adhesive strip 34A is shown, with this step not being needed in the present case since the corresponding strip of adhesive 112B was previously exposed as described in connection with FIG. 42. The second cover component of assembly 106, which includes cover board 108B, is then folded over stack 10, taking care at this point not to permit the cover component to contact the exposed adhesive 112B strip. The second cover component is positioned so that the outer edges of the cover component abut stops 148 and 150, similar to the position of corresponding cover 18A shown in FIG. 8I and in FIG. 7. The user then presses down on the cover component, similar to what is depicted in corresponding FIG. 8J, thereby causing the exposed adhesive 112B strip to be secured to the outer sheet of the bound stack 10. This action locks the outer sheet and second cover component together in the correct position. The user then lifts the second cover component up so as to expose lifting tab 126E so that the tab can be used to remove major release liner section 114B covering the remainder of adhesive layer 112B. This step generally corresponds to the step depicted in FIG. 8K. The user then presses the second cover component down against stack 10 thereby securing the cover component to the remainder of the outer sheet of the stack, as depicted in corresponding FIGS. 8L and 8M. This completes the sequence for applying the covered hardcover assembly to the stack. The completed book is similar in appearance to the prior art book shown in FIG. 9A, with the book having a so-called lay flat feature in that the spine of the over-wrap sheet 144 is not secured to the spine of the stack 10 and is thus free to flex relatively independent of the stack spine. The completed book of the present invention can, as described herein, be covered with a much wider range of materials, that being highly advantageous.

Thus, a novel method of forming an over-wrap sheet and applying the over-wrap sheet to a cover assembly has been disclosed along with a related guide. Also disclosed are a novel hardcover assembly which permits a non-adhesive over-wrap sheet to be used and related method of applying the non-adhesive over-wrap sheet. Although various embodiments of the present invention have been described in some detail, it is to be understood that various changes can be made by those skilled in the art without departing from the spirit and scope of the present invention as defined by the appended claims.

What is claimed is:

1. A method of forming and applying an over-wrap sheet to a book hardcover, said method comprising:

providing an over-wrap guide which includes a base unit;

positioning the over-wrap guide over an uncut over-wrap sheet;

cutting the uncut over-wrap sheet using the base unit as a cutting template thereby producing a cut over-wrap sheet;

positioning the hardcover on the over-wrap guide;

after positioning the hardcover on the over-wrap guide, positioning the cut over-wrap sheet over the hardcover so that at least a portion of the hardcover is disposed intermediate the over-wrap guide and the cut over-wrap sheet; and securing the cut over-wrap sheet to the hardcover.

2. The method of claim 1 wherein the uncut over-wrap sheet include printed information, wherein the over-wrap guide includes a reticule and wherein the positioning of the over-wrap guide includes aligning the reticule with the printed information.

3. The method of claim 1 wherein the uncut over-wrap sheet includes a layer of pressure sensitive adhesive covered by at least one release liner and wherein the securing includes removing the at least one release liner.

4. The method of claim 1 wherein the securing includes removing the hardcover and cut wrap-sheet from the over-wrap guide and placing a first edge of the hardcover on a folding surface, with an overhanging portion of the cut wrap-sheet being disposed between the first hardcover edge and the folding surface.

5. The method of claim 4 wherein the securing further includes, subsequent to the placing, rotating the first hardcover edge on the folding surface so that the overhanging portion is wrapped around the hardcover edge.

6. The method of claim 5 wherein the securing further includes placing a second edge of the hardcover, opposite the first edge, on the folding surface, with an overhanging portion of the cut wrap-sheet being disposed between the second hardcover edge and the folding surface and the rotating the second hardcover edge on the folding surface so that the overhanging portion is wrapped around the hardcover edge.

7. The method of claim 1 wherein the over-wrap guide includes a first set of stops and wherein the step of positioning the hardcover on the over-wrap guide includes positioning the hardcover so that first and second edges of the hardcover engage the first set of stops.

8. The method of claim 7 wherein the over-wrap guide includes a second set of stops, separate from the first set of stops, and wherein the step of positioning the over-wrap sheet over the hardcover includes positioning the over-wrap sheet so that first and second edges of the over-wrap sheet engage the second set of stops.

* * * * *